US006890058B2

(12) United States Patent
Nunokawa et al.

(10) Patent No.: US 6,890,058 B2
(45) Date of Patent: May 10, 2005

(54) PRINTING WITH MULTIPLE PRINT HEADS

(75) Inventors: Hirokazu Nunokawa, Nagano-ken (JP); Toshihisa Saruta, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 10/429,971

(22) Filed: May 6, 2003

(65) Prior Publication Data

US 2004/0051747 A1 Mar. 18, 2004

(30) Foreign Application Priority Data

May 8, 2002 (JP) ..... 2002-133051

(51) Int. Cl.[7] ..... B41J 2/145; B41J 2/15

(52) U.S. Cl. ..... 347/40

(58) Field of Search ..... 347/40–43, 9, 347/12

(56) References Cited

U.S. PATENT DOCUMENTS 4,198,642 A 4/1980 Gamblin 6,206,502 B1 * 3/2001 Kato et al. ..... 347/41

FOREIGN PATENT DOCUMENTS

JP 2001-096734 A 4/2001
JP 2001-277658 A 10/2001

* cited by examiner

*Primary Examiner*—Thinh Nguyen
(74) *Attorney, Agent, or Firm*—Sughrue Mion, PLLC

(57) ABSTRACT

Reducing deterioration of the printing quality due to the deviation of the dot forming position in the case of printing with multiple print heads.

The present invention is a printing apparatus for printing by recording ink dots on a print medium while moving a print head group in a main scan direction. In the printing apparatus closer to a center in the sub-scan direction a nozzle is, greater a recording-target pixel rate is set for the nozzle among the plurality of nozzles on each of the print head. The recording-target pixel rate being a rate of pixels in which the nozzle is in charge of a formation of a dot while the nozzle among the plurality of nozzles passing over one raster line.

15 Claims, 18 Drawing Sheets

Scanning Parameters

Nozzle pitch: k = 3
Number of working nozzles: N = 4
Number of scan repetitions: s = 1
Number of effective nozzles: Neff = 4

| Pass Number | 1 | 2 | 3 | 4 |
|---|---|---|---|---|
| Feed amount L [dot] | 0 | 4 | 4 | 4 |
| $\Sigma L$ | 0 | 4 | 8 | 12 |
| $F = (\Sigma L)\%k$ | 0 | 1 | 2 | 0 |

Overlapping Recording Method (s = 2)

Scanning Parameters

Nozzle pitch: k = 3

Number of working nozzles: N = 4

Number of scan repetitions: s = 2

Number of effective nozzles: Neff = 2

| Pass Number | 1 | 2 | 3 | 4 | 5 | 6 | 7 |
|---|---|---|---|---|---|---|---|
| Pixels for recording | 0 | 1 | 0 | 1 | 0 | 1 | 0 |
| Feed amount L [dot] | 0 | 2 | 2 | 2 | 2 | 2 | 2 |
| ΣL | 0 | 2 | 4 | 6 | 8 | 10 | 12 |
| F=(ΣL)%k | 0 | 2 | 1 | 0 | 2 | 1 | 0 |

Pixels for recording "0": Even numbered pixel positions

Pixels for recording "1": Odd numbered pixel positions

Fig.11

Raster data allocated to each nozzle for each pixel position
(The first embodiment)

| Raster direction pixel position number | 1 | 2 | 3 | 4 | 5 | 6 | 7 | 8 |
|---|---|---|---|---|---|---|---|---|
| Raster data of the first raster | 1 | 1 | 1 | 1 | 0 | 1 | 1 | 1 |
| Raster data of nozzle #1b | 0* | 1 | 0* | 0* | 0* | 1 | 0* | 0* |
| Raster data of nozzle #3a | 1 | 0* | 1 | 0* | 0 | 0* | 1 | 0* |
| Raster data of nozzle #8b | 0* | 0* | 0* | 1 | 0* | 0* | 0* | 1 |
| Raster data of the second raster | 1 | 1 | 1 | 1 | 1 | 1 | 1 | 1 |
| Raster data of nozzle #3b | 1 | 0* | 1 | 0* | 1 | 0* | 1 | 0* |
| Raster data of nozzle #5a | 0* | 1 | 0* | 1 | 0* | 1 | 0* | 1 |
| Raster data of the third raster | 1 | 0 | 1 | 0 | 0 | 1 | 1 | 0 |
| Raster data of nozzle #5b | 1 | 0* | 1 | 0* | 0 | 0* | 1 | 0* |
| Raster data of nozzle #7a | 0* | 0 | 0* | 0 | 0* | 1 | 0* | 1 |

"0*": Pixel positions for which data cannot be allocated

1: Recording
0: No recording
0*: Dummy data

Overlapping
(when forming dots on odd numbered pixel positions)

Overlapping
(when forming dots on even numbered pixel positions)

Fig.17

Raster data allocated to each nozzle for each pixel position
(The second embodiment)

| Raster direction pixel position number | 1 | 2 | 3 | 4 | 5 | 6 | 7 | 8 |
|---|---|---|---|---|---|---|---|---|
| Raster data of the first raster | 1 | 1 | 1 | 1 | 0 | 1 | 1 | 1 |
| Raster data of nozzle #2b | 0* | – | 1 | – | 0* | – | 0* | – |
| Raster data of nozzle #5b | – | 1 | – | 1 | – | 0* | – | 0* |
| Raster data of nozzle #8b | 1 | – | 0* | – | 0* | – | 0* | – |
| Raster data of nozzle #2a | 0* | – | 0* | – | 0* | – | 1 | – |
| Raster data of nozzle #5a | – | 0* | – | 0* | – | 1 | – | 1 |
| Raster data of nozzle #8a | 0* | – | 0* | – | 0 | – | 0* | – |
| Raster data of the second raster | 1 | 1 | 1 | 1 | 1 | 1 | 1 | 1 |
| Raster data of nozzle #3b | 1 | – | 1 | – | 0* | – | 0* | – |
| Raster data of nozzle #6b | – | 1 | – | 1 | – | 0* | – | 0* |
| Raster data of nozzle #3a | 0* | – | 0* | – | 1 | – | 1 | – |
| Raster data of nozzle #6a | – | 0* | – | 0* | – | 1 | – | 1 |
| Raster data of the third raster | 1 | 0 | 1 | 0 | 0 | 1 | 1 | 0 |
| Raster data of nozzle #1b | 0* | – | 1 | – | 0* | – | 0* | – |
| Raster data of nozzle #4b | – | 0 | – | 0 | – | 0* | – | 0* |
| Raster data of nozzle #7b | 1 | – | 0* | – | 0* | – | 0* | – |
| Raster data of nozzle #1a | 0* | – | 0* | – | 0* | – | 1 | – |
| Raster data of nozzle #4a | – | 0* | – | 0* | – | 1 | – | 0 |
| Raster data of nozzle #7a | 0* | – | 0* | – | 0 | – | 0* | – |

Recorded with print head 28b

Recorded with print head 28a

"–": Pixel positions for which data cannot be allocated

1 : Recording
0 : No recording
0* : Dummy data

PRINTING WITH MULTIPLE PRINT HEADS

BACKGROUND OF THE INVENTION

1. Field of the Invention

The present invention relates to a printing technique that forms dots on a printing medium with multiple print heads.

2. Description of the Related Art

Color printers which eject several color inks with a print head to form ink dots on a printing medium have become widely used. High-speed printing apparatuses with multiple print heads have also been proposed.

In the case of printing with multiple print heads, there is a positional misalignment of the multiple print heads. This results in a greater deviation of the dot forming position, compared with printing with a single print head. The deviation of the dot forming position undesirably deteriorates the printing quality.

SUMMARY OF THE INVENTION

The object of the present invention is thus to solve the drawback of the prior art technique and to provide a technique of reducing deterioration of the printing quality due to the deviation of the dot forming position in the case of printing with multiple print heads.

In order to attain the above and the other objects of the present invention, there is provided a printing apparatus for printing by recording ink dots on a print medium while moving a print head group in a main scan direction. The print head group includes a plurality of print heads located at different positions in a sub-scan direction. Each of the plurality of print heads have a plurality of nozzles arrayed along the sub-scan direction. The printing apparatus is configured such that a nozzle located closer to a center in the sub-scan direction on the each print head has a greater recording-target pixel rate. The recording-target pixel rate is a rate of pixels in which the nozzle is in charge of a formation of a dot while the nozzle among the plurality of nozzles passing over one raster line.

The printing apparatus of the invention is set such that the nozzle located closer to the center in the sub-scan direction on each print head has a greater recording-target pixel rate. This arrangement effectively reduces deterioration of the printing quality due to the deviation of the dot forming position in the course of printing with multiple print heads.

In one preferable arrangement of the printing apparatus, the printing apparatus is configured such that a plurality of print heads are used to record each raster line.

This arrangement effectively prevents the printing quality from being significantly deteriorated, due to an attachment error of part of the print heads, by printing with multiple print heads.

In the above printing apparatus, the recording-target pixel rate of each nozzle may be set such that each of the plurality of nozzles is allowed to form dots intermittently at a rate of one in q (an integer of at least two) on a plurality of pixel positions on the raster line, thereby completing dot formation on the raster line while the plurality of nozzles scan on the raster line in a printing execution area of the print medium during a plurality of main scans.

The technique of the invention is applicable to the intermittent overlapping recording method. In the structure of forming dots only in an intermittent manner, the degree of freedom tends to be restricted in settings of the target pixels recorded with the respective nozzles. The effects of the invention are significant in this structure, since the respective nozzles often have non-uniform settings of the recording-target pixel rate.

In the above printing apparatus, the plurality of print heads include a plurality of nozzles arrayed in the sub-scan direction at a pitch of k×P. The k is an integer of at least two. The printing apparatus further comprises a main scan driver, a sub-scan driver, a print head driver, and a controller. The main scan driver is configured to move the print heads in the main scan direction. The sub-scan driver is configured to move the print medium in the sub-scan direction between the main scans. The print head driver is configured to drive the print head group to eject ink drops during the main scan of the print heads. The controller is configured to control the main scan driver, the sub-scan driver, and the print head driver. The controller in a specific print mode is capable of: (a) controlling the print head driver such that the print head group ejects ink drops so as to record each raster lines with nozzles included in the plurality of print heads; and (b) controlling the sub-scan driver such that the sub-scan driver performs a constant sub-scan of F×P. P is a minimum pitch of dots in the sub-scan direction. F is an integer. The specific print mode is configured such that N and parameters F, g, S, R satisfy equations (1) and (2).

$$F=g\times k\pm 1 \tag{1}$$

$$N=F\times S+R \tag{2}$$

where N denotes a number of working nozzles for ejecting one color of ink in each print head during each main scan, and N is an integer of at least three, and the parameters g, S, R are an integer of at least one.

The application sets the sub-scan feed amount to have a greater number of overlaps in the main scan line formed with R (at least one) end nozzles, which are located in the vicinity of the end of the print head and cause greater deviations of the dot forming position. This arrangement thus sets a smaller value to the recording-target pixel rate with regard to such end nozzles. Here it is preferable that R is equal to any of integers 2 to 5.

The present invention can be realized in various forms such as a method and apparatus for printing, a method and apparatus for printing control, and a computer-readable medium implementing the above scheme.

BRIEF DESCRIPTION OF THE DRAWINGS

FIG. 11 is an explanatory view showing raster data allocated to each nozzle in the first embodiment of the invention;

FIG. 17 is an explanatory view showing raster data allocated to each nozzle in the second embodiment of the invention;

DESCRIPTION OF THE PREFERRED EMBODIMENTS

Some modes of carrying out the invention are discussed below as preferred embodiments in the following sequence:

A. Structure of Apparatus

B. Basic Conditions of the Recording Method

C. Recording Method in the First Embodiment

D. Recording Method in the Second Embodiment

E. Relation between Number of Surplus Nozzles and Number of Overlaps

F. Modifications

A. Structure of Apparatus

Figure 1:
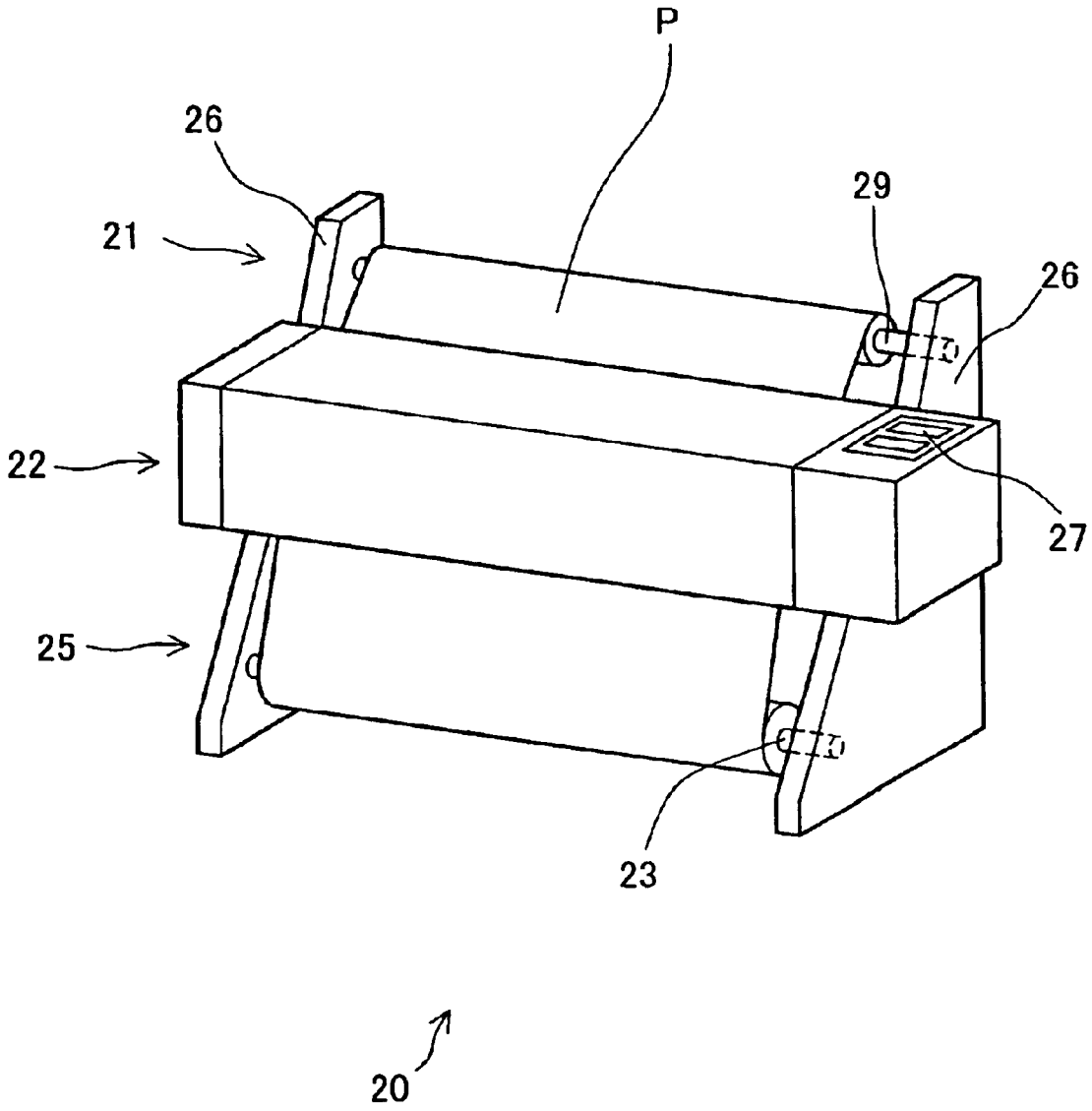
FIG. 1 is a perspective view schematically illustrating the structure of a color printer in one embodiment of the present invention.

FIG. 1 is a perspective view schematically illustrating the structure of a color printer 20 in one embodiment of the present invention. The color printer 20 is suitably used for relatively large-sized printing paper P, such as size A0 or B0 paper in conformity with the JIS standards (Japanese Industrial Standards) or roll paper. The printing paper P is fed from a paper feed unit 21 to a printing unit 22. The printing unit 22 ejects ink for printing on the fed printing paper P and delivers the printing paper P with the print to a paper delivery unit 25.

The paper feed unit 21 has a roll paper holder 29, on which roll paper as the printing paper P is settable. The roll paper holder 29 is held by two support columns 26 of the color printer 20. The paper delivery unit 25 has a windup holder 23, on which the roll paper is windable. Like the roll paper holder 29, the windup holder 23 is held by the two support columns 26 and is rotatable by a non-illustrated drive unit.

Figure 2:
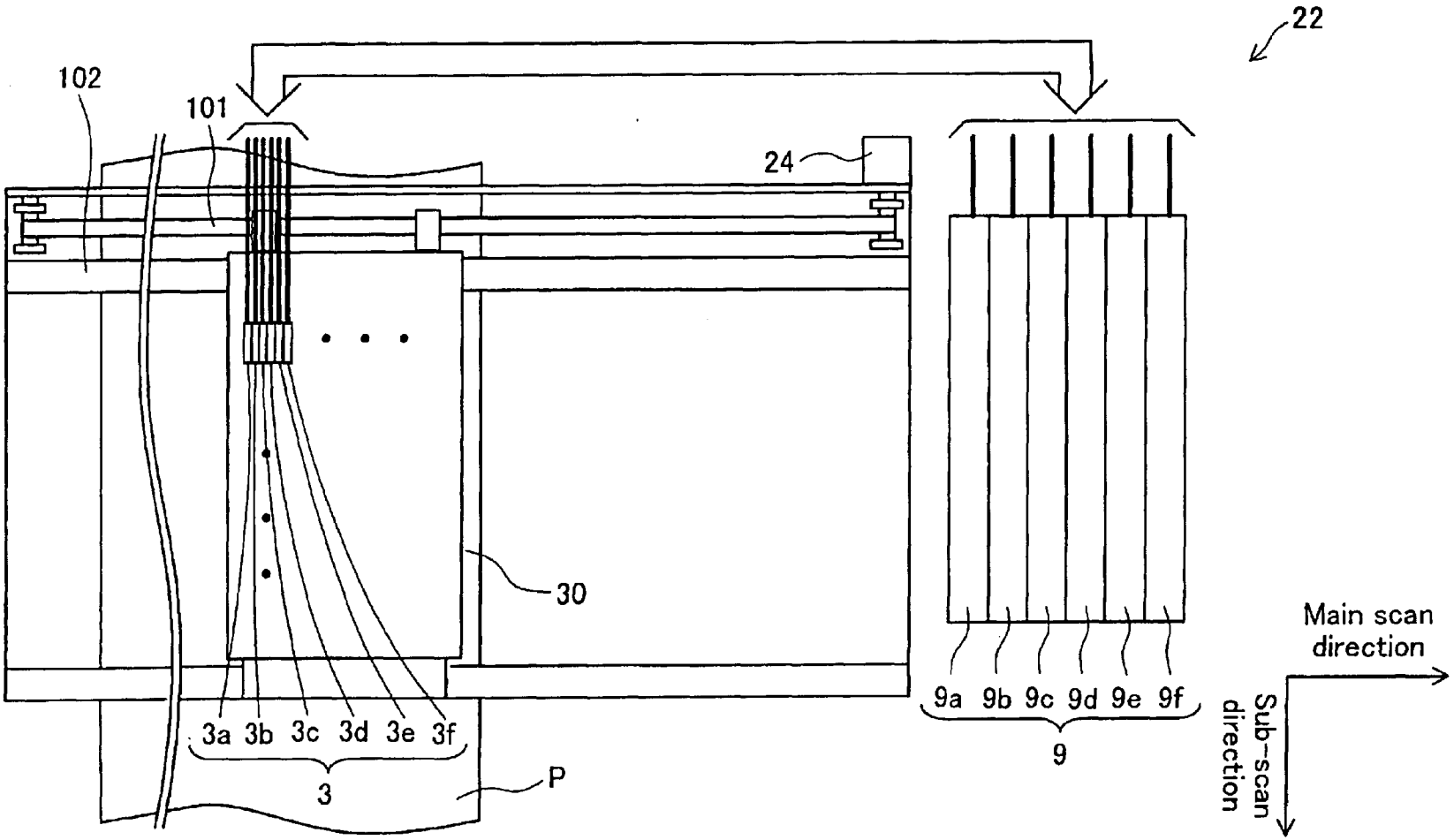
FIG. 2 is an explanatory view illustrating the structure of a printing unit included in the color printer of FIG. 1.

FIG. 2 is an explanatory view illustrating the structure of the printing unit 22. The printing unit 22 has a carriage 30, on which multiple print heads discussed later are mounted. The carriage 30 is linked with a drive belt 101 actuated by a carriage motor 24, and is guided by a main scan guide member 102 to be movable in a main scan direction.

Figure 3:
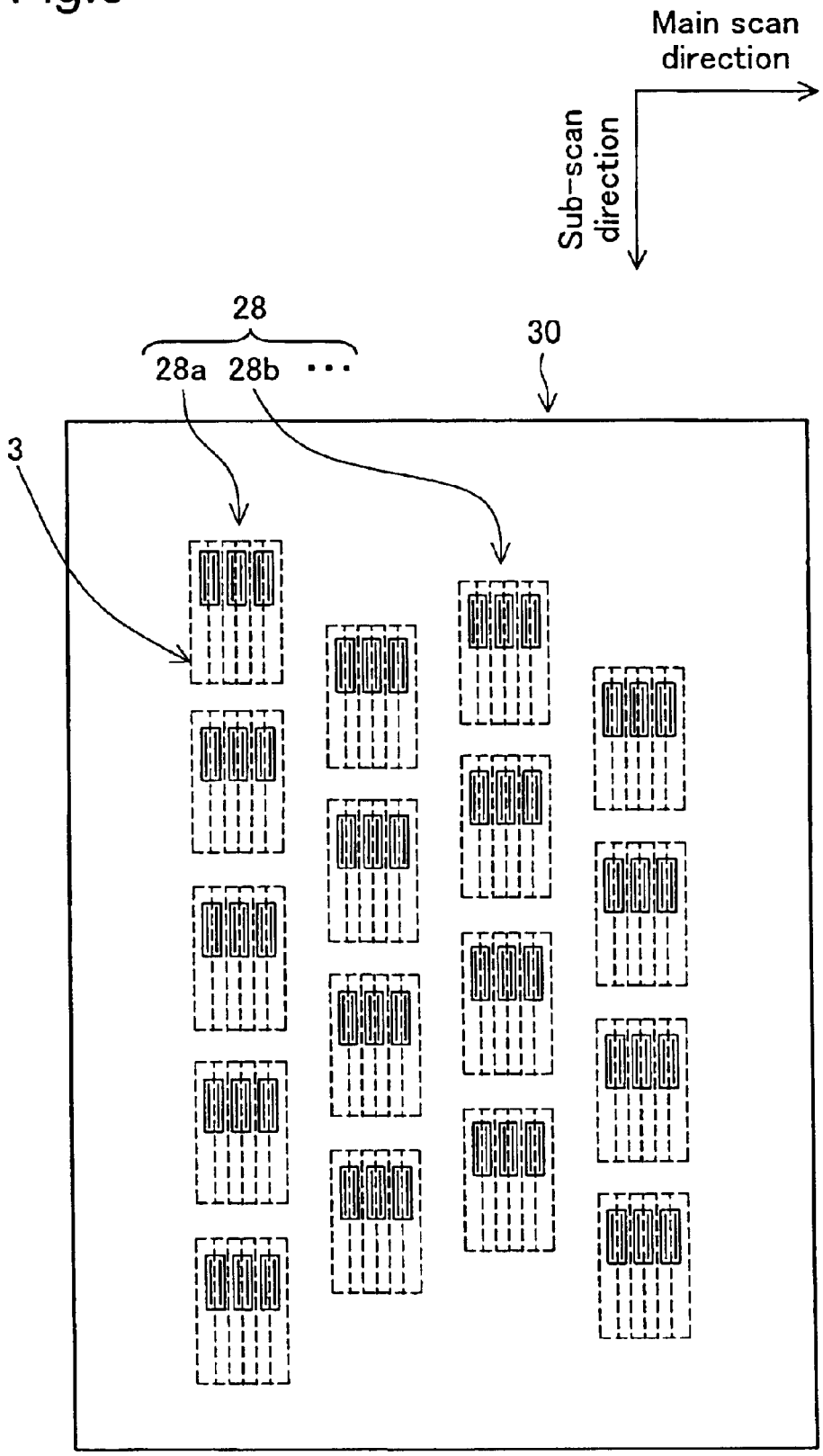
FIG. 3 is an explanatory view showing the outline of a carriage included in the printing unit of FIG. 2.

FIG. 3 is an explanatory view showing the outline of the carriage 30. The carriage 30 has a print head group 28 consisting of multiple print heads 28*a*, 28*b*, . . . Each of the print heads 28*a*, 28*b*, . . . includes a sub-tank 3, in which ink is temporarily reserved. The sub-tank 3 is connected to a main tank 9 via an ink supply passage 103 (see FIG. 2). The main tank 9 stores six color inks, black K, cyan C, light cyan LC, magenta M, light magenta LM, and yellow Y, ejected from the respective print heads 28*a*, 28*b*, . . .

Figure 4:
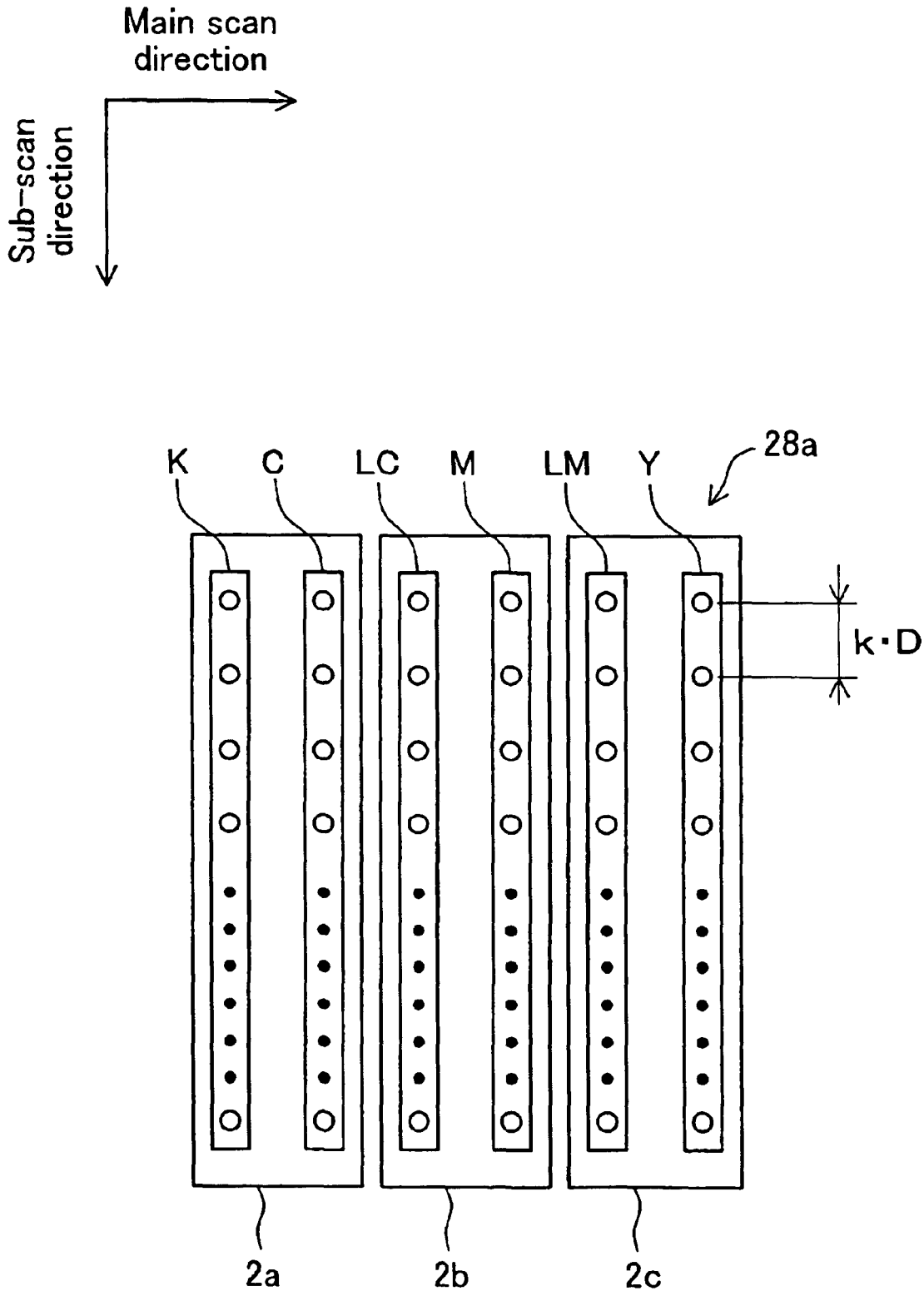
FIG. 4 is an explanatory view showing a bottom face of one print head.

FIG. 4 is an explanatory view showing a bottom face of one print head 28*a*. The print head 28*a* has three nozzle plates 2*a*, 2*b*, and 2*c*. Two nozzle arrays, which are capable of ejecting different inks, are provided on the lower face of each nozzle plate. The print head 28*a* thus totally has six nozzle arrays. The six color inks, black (K), cyan (C), light cyan (LC), magenta (M), light magenta (LM), and yellow (Y), are ejected respectively from the six nozzle arrays. All the print heads 28*a*, 28*b*, . . . have an identical structure.

Multiple nozzles in each nozzle array are arranged in a sub-scan direction at a fixed nozzle pitch k–D. Here k represents an integer and D represents a pitch corresponding to a printing resolution in the sub-scan direction (called 'dot pitch'). In the specification hereof, this is also expressed as 'the nozzle pitch is k dots'. Here the unit 'dot' means the dot pitch of the printing resolution. The unit 'dot' is also applied for the sub-scan feed amount.

Each nozzle has a piezoelectric element (not shown) as an actuator element to actuate each nozzle for ejection of ink droplets. In the course of printing, ink droplets are ejected from the respective nozzles, while the print head group 28 moves in the main scan direction.

The multiple nozzles in each nozzle array may not be aligned in the sub-scan direction but may have a different arrangement, for example, a zigzag configuration. In the case of the zigzag configuration of the nozzles, the nozzle pitch k–D in the sub-scan direction is defined in the same manner as FIG. 2. In the specification hereof, the expression 'multiple nozzles arranged in the sub-scan direction' is used in a wide sense and includes both the nozzles aligned and the nozzles arranged in zigzag.

Figure 5:
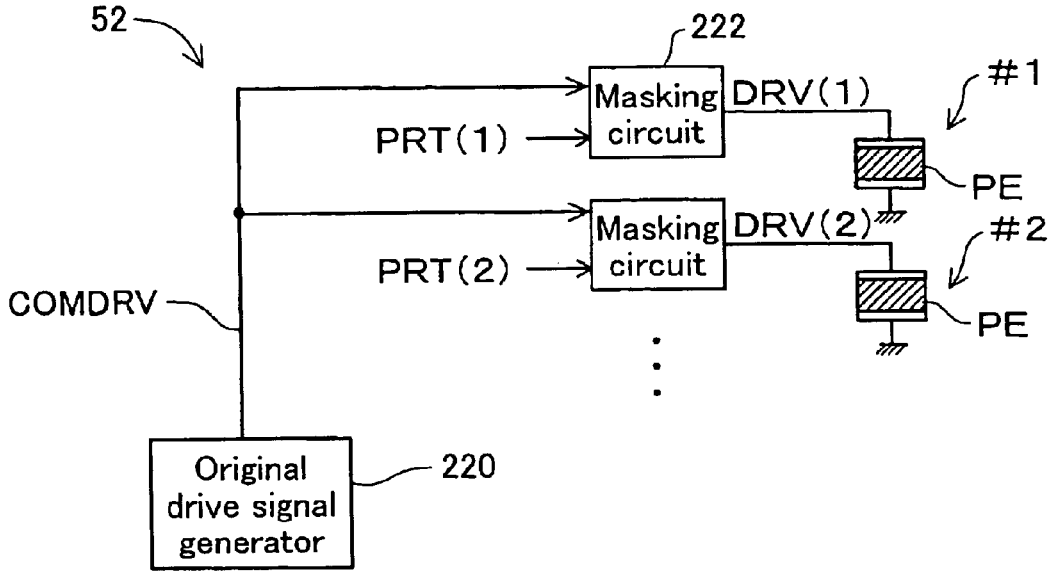
FIG. 5 is an explanatory view showing the main structure of a head drive circuit that drives a print head group to eject inks.

FIG. 5 is an explanatory view showing the main structure of a head drive circuit 52 that drives the print head group 28 to eject inks. The head drive circuit 52 includes an original drive signal generator 220, multiple mask circuits 222, and piezoelectric elements PE of the respective nozzles. The mask circuits 222 correspond to respective nozzles #1, #2, . . . of the print head group 28. In the illustration of FIG. 5, each figure in brackets suffixed to each signal name represents a nozzle number, to which the signal is supplied.

Figure 6:
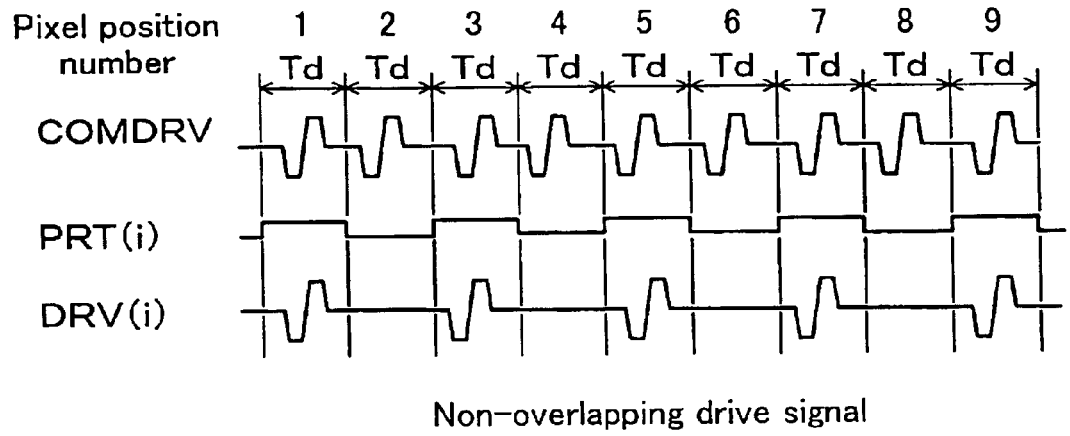
FIG. 6 is a timing chart showing operations of the head drive circuit in a non-overlapping interlace method.

FIG. 6 is a timing chart showing operations of the head drive circuit 52 in a non-overlapping interlace method. The original drive signal generator 220 generates an original drive signal COMDRV, which is commonly used for the respective nozzles, and supplies the original drive signal COMDRV to the multiple mask circuits 222. The original drive signal COMDRV includes one pulse in a main scan period Td of one pixel. The i-th mask circuit 222 masks the original drive signal COMDRV according to the level of a serial print signal PRT(i) supplied to the i-th nozzle.

More specifically, the mask circuit 222 allows transmission of the original drive signal COMDRV at a level '1' of the print signal PRT(i). The transmitted original drive signal is then supplied as a drive signal DRV to the piezoelectric element PE. The mask circuit 222 blocks the original drive signal COMDRV at a level '0' of the print signal PRT(i). The serial print signal PRT(i) represents a recording status of each pixel recorded by the i-th nozzle in one main scan. FIG. 6 shows an example in the case of recording dots in every other pixel. In the case of recording dots in every pixel, the original drive signal COMDRV is supplied without any switching as the drive signal DRV to the piezoelectric element PE.

In the color printer 20 having the hardware construction discussed above, while the paper P is fed via the windup holder 23, the carriage 30 is reciprocated by the carriage motor 24. Simultaneously, the piezoelectric elements of the print head group 28 are actuated to eject ink droplets of the respective color inks and form ink dots, thus forming a multi-color, multi-tone image on the paper P.

B. Basic Conditions of the Recording Method:

Before giving a detailed explanation of the recording method used in the embodiments of the present invention, first, the basic conditions of a normal interlace recording method is explained hereafter. An "interlace recording method" means a recording method that is used when the nozzle pitch k in the sub-scan direction is two or greater. With an interlace recording method, with one main scan, a raster line that cannot be recorded is left between adjacent nozzles, and the pixels on this raster line are recorded during another main scan. In this specification, "printing method" and "recording method" are synonyms. A raster line is also called "main scan line".

Figures 7A, 7B:
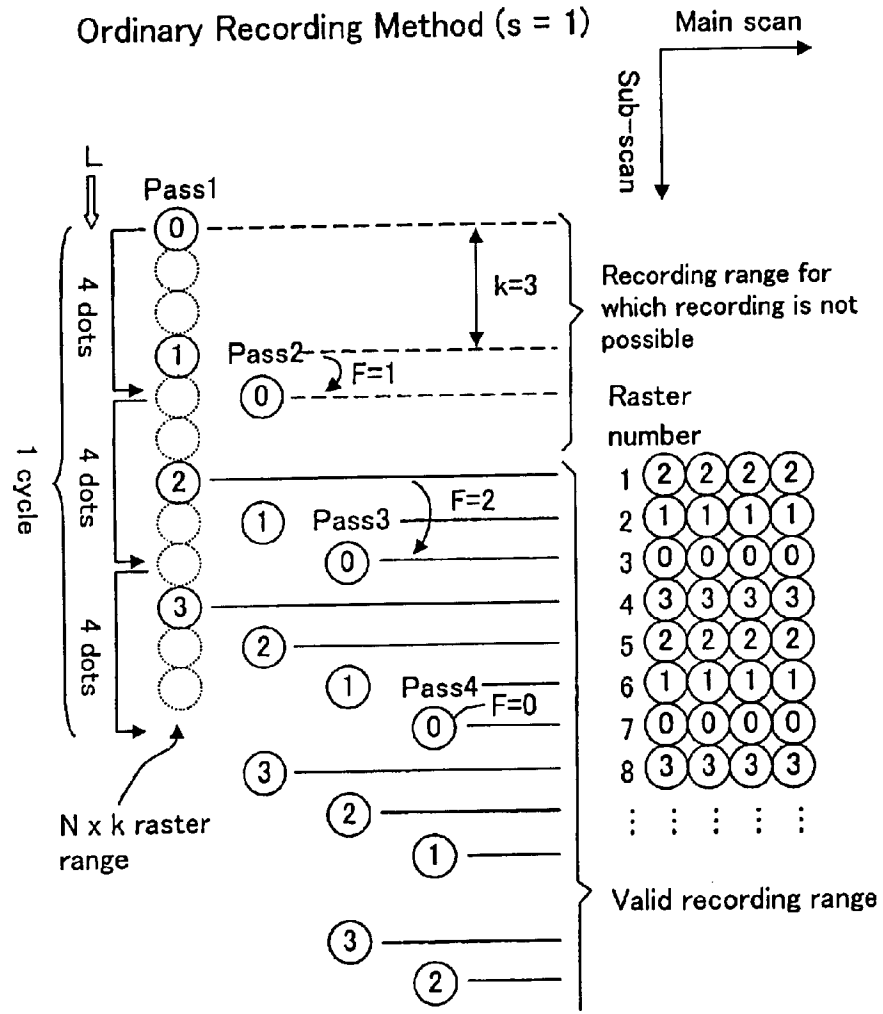
FIGS. 7A and 7B show an example of sub-scan feed on the basic conditions of a normal interlace recording method.

FIG. 7A shows an example of sub-scan feed on the basic conditions of a normal interlace recording method, and FIG. 7B shows the parameters of that dot recording on the basic conditions. In FIG. 7A, the solid line circle around the numbers indicates positions of the four nozzles in the sub-scan direction for each pass. The term "pass" means one main scan. The numbers 0 through 3 in the circles indicate the nozzle numbers. The positions of the four nozzles shift in the sub-scan direction each time one main scan ends. However, in reality, the sub-scan direction feed is realized by movement of the paper by windup holder 23 (FIG. 2).

As shown at the left side of FIG. 7A, sub-scan feed amount L is a fixed or constant value of four dots in this example. Therefore, each time a sub-scan feed is done, the position of the four nozzles shifts by four dots each in the sub-scan direction. Each nozzle has as a recording target all dot positions (also called "pixel positions") on each raster line during one main scan. In this specification, the total number of main scans performed on each raster line (also called "main scan lines") is called "scan repetition count s."

At the right side of FIG. 7A is shown the ordinal number of the nozzle that records dots on each raster line. With the raster lines drawn by a dotted line extending in the right direction (main scan direction) from the circles that indicate the sub-scan direction position of the nozzles, at least one of the raster lines above or below this cannot be recorded, so in fact, dot recording is prohibited. Meanwhile, the raster lines drawn by a solid line extending in the main scan direction are in a range for which dots can be recorded on the raster lines before and after them. The range for which recording can actually be done will hereafter be called the valid recording range (or "valid recording range," "printing execution area," or "recording execution area").

In FIG. 7B, various parameters relating to this dot recording method are shown. Dot recording method parameters include nozzle pitch k (dots), the number of working nozzles N, the scan repetition count s, the effective nozzle count Neff, and sub-scan feed amount L (dots).

In the example in FIGS. 7A and 7B, nozzle pitch k is 3 dots. Number of working nozzles N is 4. Also, number of working nozzles N is the number of nozzles actually used among the multiple nozzles that are installed. Scan repetition count s means that main scans are executed s times on each raster line. For example, when scan repetition count s is two, main scans are executed twice on each raster line. At this time, normally dots are formed intermittently at every other dot position on one main scan. In the case shown in FIGS. 7A and 7B, the scan repetition count s is one. The effective nozzle count Neff is a value of working nozzle number N divided by scan repetition count s. This effective nozzle count Neff can be thought of as showing the net number of the raster lines for which dot recording is completed with one main scan.

In the table in FIG. 7B, the sub-scan feed amount L, its sum value ΣL, and nozzle offset F are shown for each pass. Here, offset F indicates how many dots the nozzle position is separated in the sub-scan direction from the reference positions for each pass; the reference positions for which the offset is zero are cyclical positions of the nozzles (in FIGS. 7A and 7B, a position every three dots) at the first pass. For example, as shown in FIG. 7A, after pass 1, the nozzle position moves in the sub-scan direction by sub-scan feed amount L (4 dots). Meanwhile, nozzle pitch k is 3 dots. Therefore, the nozzle offset F for pass 2 is 1 (see FIG. 7A). Similarly, the nozzle position for pass 3 is moved from the initial position by ΣL=8 dots, and the offset F is 2. The nozzle position for pass 4 moves ΣL=12 dots from the initial position, and the offset F is 0. With pass 4 after three sub-scan feeds, nozzle offset F returns to 0, and by repeating a cycle of three sub-scans, it is possible to record dots on all raster lines in the valid recording range.

As can be understood from the example in FIGS. 7A and 7B, when the nozzle position is in a position separated by an integral multiple of nozzle pitch k from the initial position, offset F is 0. In addition, offset F can be given by remainder (ΣL) % k, which is obtained by dividing cumulative value ΣL of sub-scan feed amount L by nozzle pitch k. Here, "%" is an operator that indicates that the division remainder is taken. If we think of the nozzle initial position as a cyclical position, we can also think of offset F as showing the phase shift amount from the initial position of the nozzle.

When the scan repetition count s is 1, to have no gaps or overlap in the raster line that is to be recorded in the valid recording range, the following conditions must be met.

Condition c1: The number of sub-scan feeds of one cycle is equal to nozzle pitch k.

Condition c2: Nozzle offset F after each sub-scan feed in one cycle assumes a different value in a range from 0 to (k−1).

Condition c3: The average sub-scan feed amount (ΣL/k) is equal to the working nozzle number N. In other words, the cumulative value ΣL of sub-scan feed amount L per cycle is equal to the working nozzle number N multiplied by nozzle pitch k, (N×k).

Each of the aforementioned conditions can be understood by thinking as follows. There are (k−1) raster lines between adjacent nozzles. In order for a nozzle to return to the reference position (position where offset F is 0) while performing recording on these (k−1) raster lines during one cycle, the number of sub-scan feeds in one cycle will be k. If the number of sub-scan feeds in one cycle is less than k, there will be gaps in the recorded raster lines, and if there are more than k sub-scan feeds in one cycle, there will be overlap in the recorded raster lines. Therefore, the aforementioned first condition c1 is established.

When the number of sub-scan feeds in one cycle is k, gaps and overlaps in the recorded raster lines are eliminated only when the values of offset F after each sub-scan feed are different from each other in the range 0 to (k−1). Therefore, the aforementioned second condition c2 is established.

If the aforementioned first and second conditions are established, during one cycle, recording of k raster lines will be performed for each of N nozzles. Therefore, with one cycle, recording of N×k raster lines is performed. Meanwhile, if the aforementioned third condition c3 is met, as shown in FIG. 7A, the nozzle position after one cycle (after k sub-scan feeds) comes to a position separated by N×k raster lines from the initial nozzle position. Therefore, by fulfilling the aforementioned first through third conditions c1 to c3, it is possible to eliminate gaps and overlaps in the range of these N×k raster lines.

Figures 8A, 8B:
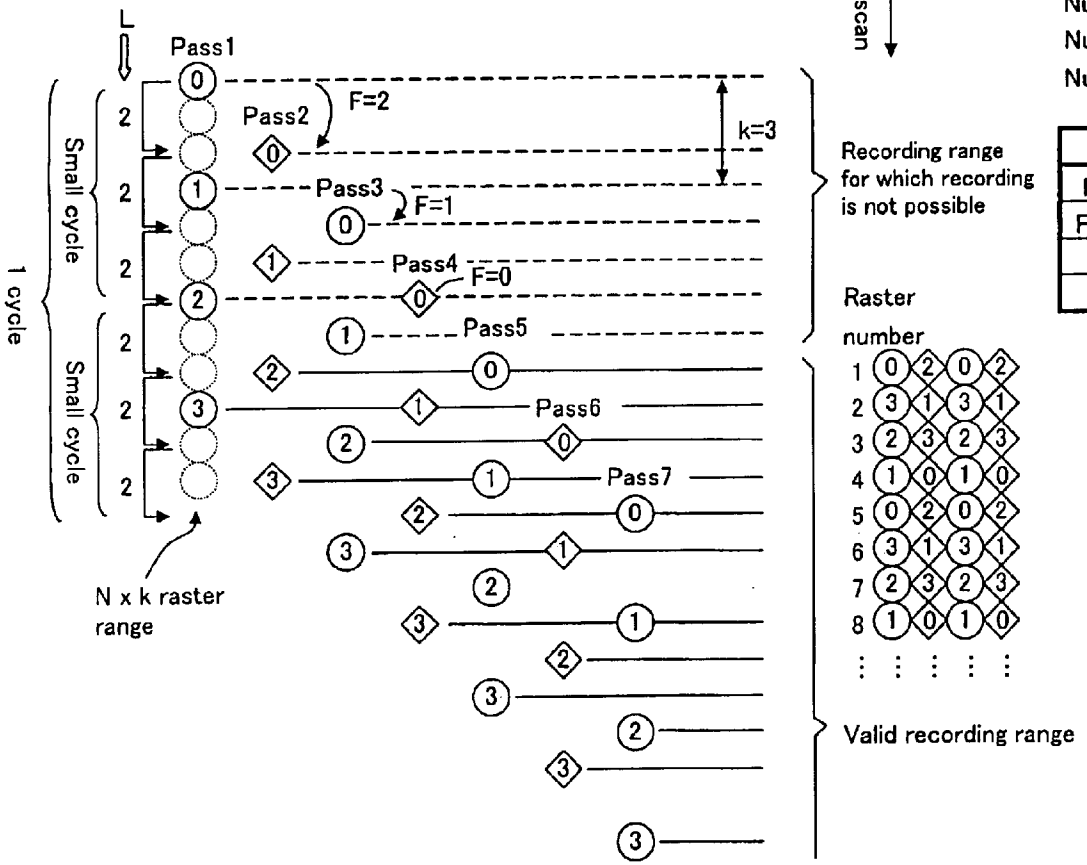
FIGS. 8A and 8B show an example of sub-scan feed on the basic conditions of an overlapping interlace recording method.

FIGS. 8A and 8B show the basic conditions of a dot recording method when the scan repetition count s is two. Hereafter, we will call a dot recording method for which the scan repetition count s is 2 or greater an "overlapping method". FIG. 8A shows an example of sub-scan feed of the overlapping interlace recording method, and FIG. 8B shows its parameters. When the scan repetition count s is 2 or greater, main scanning is executed s times on the same raster line.

The dot recording method shown in FIGS. 8A and 8B has a different scan repetition count s and sub-scan feed amount L for the parameters of the dot recording method shown in FIG. 8B. As can be seen from FIG. 8A, the sub-scan feed amount L of the dot recording method in FIGS. 8A and 8B is a fixed value of 2 dots. In FIG. 8A, the positions of nozzles at even numbered passes are shown by a diamond shape. Normally, as shown at the right side of FIG. 8A, the recorded dot positions on even numbered passes are shifted by one dot in the main scan direction from those on the odd numbered passes. Therefore, multiple dots on the same raster line are intermittently recorded by two different nozzles. For example, the topmost raster line within the valid recording range is intermittently recorded every other dot by the #0 nozzle on pass 5 after intermittent recording is done every other dot by the #2 nozzle on pass 2. With this overlapping method, each nozzle is driven with intermittent timing so that (s−1) dot recording is prohibited after 1 dot is recorded during one main scan.

In this way, the overlapping method that has intermittent pixel positions on a raster line as a recording target during each main scan is called an "intermittent overlapping method". Also, instead of having intermittent pixel positions as the recording target, it is also possible to have all pixel positions on a raster line during each main scan be the recording target. In other words, when executing a main scan s times on one raster line, it is allowable to overstrike dots on the same pixel position. This kind of overlapping method is called an "overstrike overlapping method" or "complete overlapping method".

With an intermittent overlapping method, it is acceptable, as far as the target pixel positions of the multiple nozzles on the same raster line are shifted in relation to each other, so for the actual shift amount in the main scan direction during each main scan, a variety of shift amounts other than that shown in FIG. 8A are possible. For example, it is also possible to record dots in the positions shown by circles without shifting in the main scan direction on pass 2, and to record the dots in the positions shown by diamonds with the shift in the main scan direction performed on pass 5.

The value of offset F of each pass in one cycle is shown at the bottom of the table in FIG. 8B. One cycle includes six passes, and offset F for pass 2 to pass 7 includes a value in the range of zero to two twice each. Also, the change in offset F for three passes from pass 2 to pass 4 is equal to the change in offset F for three passes from pass 5 to pass 7. As shown at the left side of FIG. 8A, the six passes of one cycle can be segmented into two small cycles of three passes each. At this time, one cycle ends by repeating a small cycle s times.

Generally, when scan repetition count s is an integer of two or greater, the first through third conditions c1 through c3 described above can be rewritten as the following conditions c1' through c3'.

Condition c1': The sub-scan feed count of one cycle is equal to the multiplied value of nozzle pitch k and scan repetition count s, (k×s).

Condition c2': Nozzle offset F after each of the sub-scan feeds in one cycle assumes a value in the range of 0 through (k−1), and each value is repeated s times.

Condition c3': The sub-scan average feed amount {ΣL/(k×s)} is equal to effective nozzle count Neff (=N/s). In other words, cumulative value ΣL of sub-scan feed amount L per cycle is equal to the multiplied value of effective nozzle count Neff and the sub-scan feed count (k×s), {Neff×(k×s)}.

The aforementioned conditions c1' through c3' also holds when scan repetition count s is one. Therefore, conditions c1' to c3' can be thought of as conditions that are generally established in interlace recording methods regardless of the value of scan repetition count s. In other words, if the aforementioned three conditions c1' through c3' are satisfied, it is possible to eliminate gaps and unnecessary overlaps for recorded dots in the valid recording range. However, when using the intermittent overlapping method, a condition is required whereby the recording positions of nozzles that record on the same raster line are shifted in relation to each other in the main scan direction. In addition, when using an overstrike overlapping method, it is enough to satisfy the aforementioned conditions c1' to c3', and for each pass, all pixel positions are subject to recording.

In FIGS. 7A, 7B, 8A, and 8B, cases when sub-scan feed amount L is a fixed value are explained, but the aforementioned conditions c1' to c3' can be applied not only in cases when sub-scan feed amount L is a fixed value, but also in cases of using a combination of multiple different values as the sub-scan feed amount. Note that in this specification, sub-scan feeds for which feed amount L is a fixed value are called "constant feeds," and sub-scan feeds that use combinations of multiple different values as the feed amount are called "variable feeds."

C. Recording Method in First Embodiment

Figure 9:
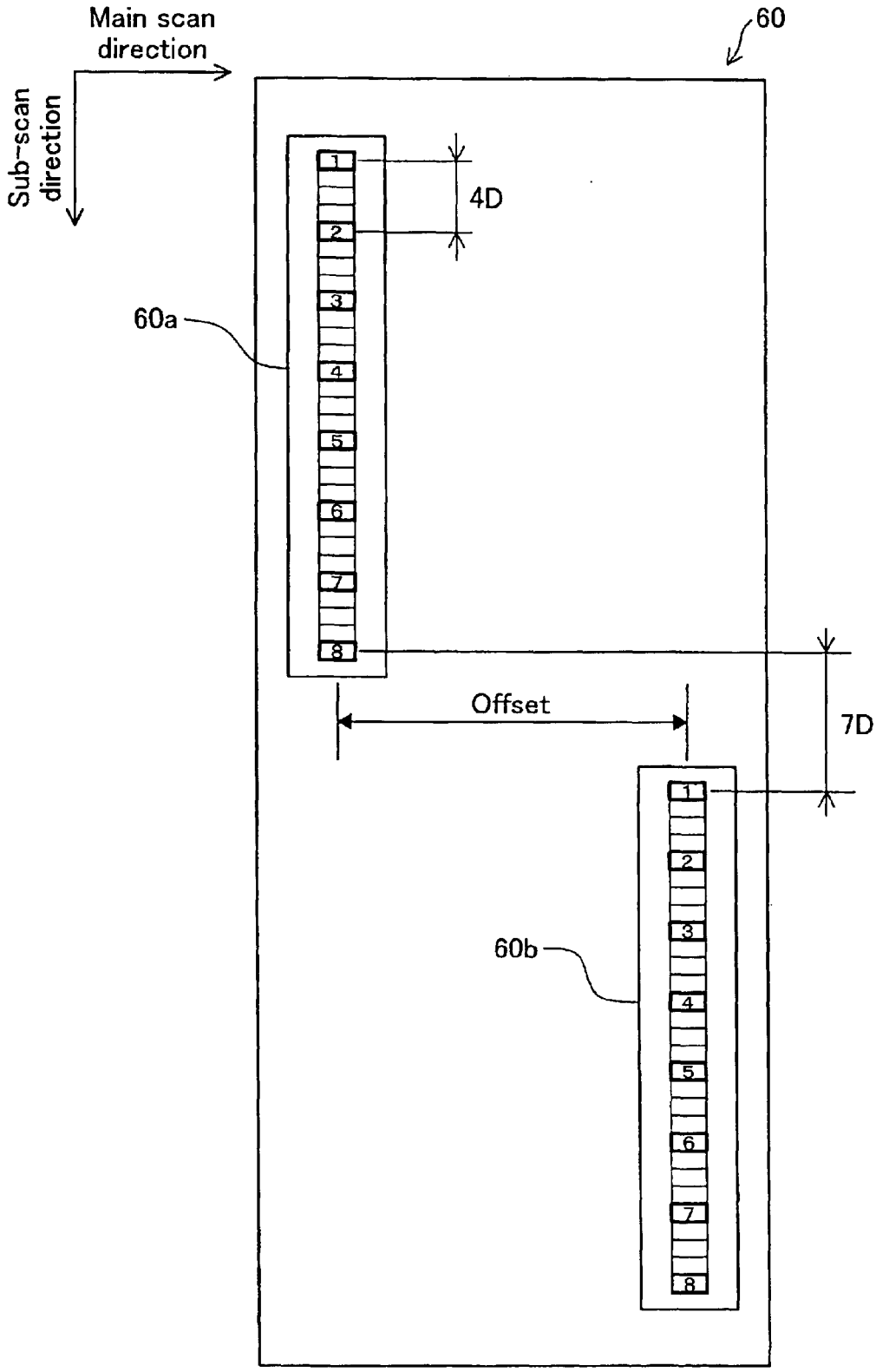
FIG. 9 is an explanatory view illustrating a simplified print head used for describing the recording methods in embodiments of the invention.

FIG. 9 is an explanatory view showing a simplified print head group 60 used for describing the recording methods in embodiments of the invention. The print head group 60 includes two print heads 60*a* and 60*b*. The print heads 60*a* and 60*b* represent nozzle arrays that are respectively included in the print head 28*a* (FIG. 4) and the print head 28*b* on the carriage 30 (FIG. 3) to eject the black ink K. For the simplicity of explanation, the recording methods of the embodiments are described with this simplified print head group 60.

Figure 10:
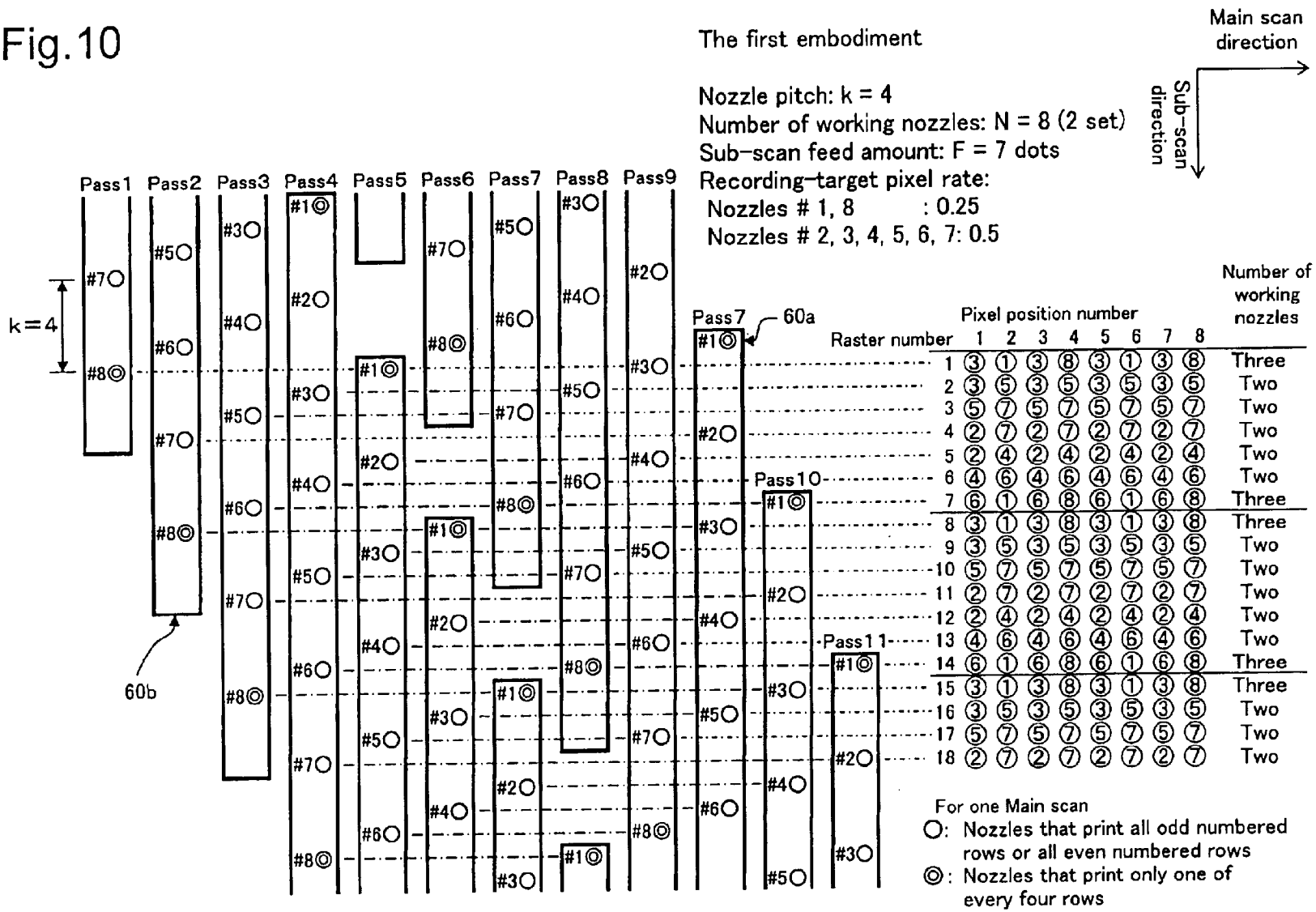
FIG. 10 is an explanatory view showing a dot recording method in a first embodiment of the invention.
Figure 12:
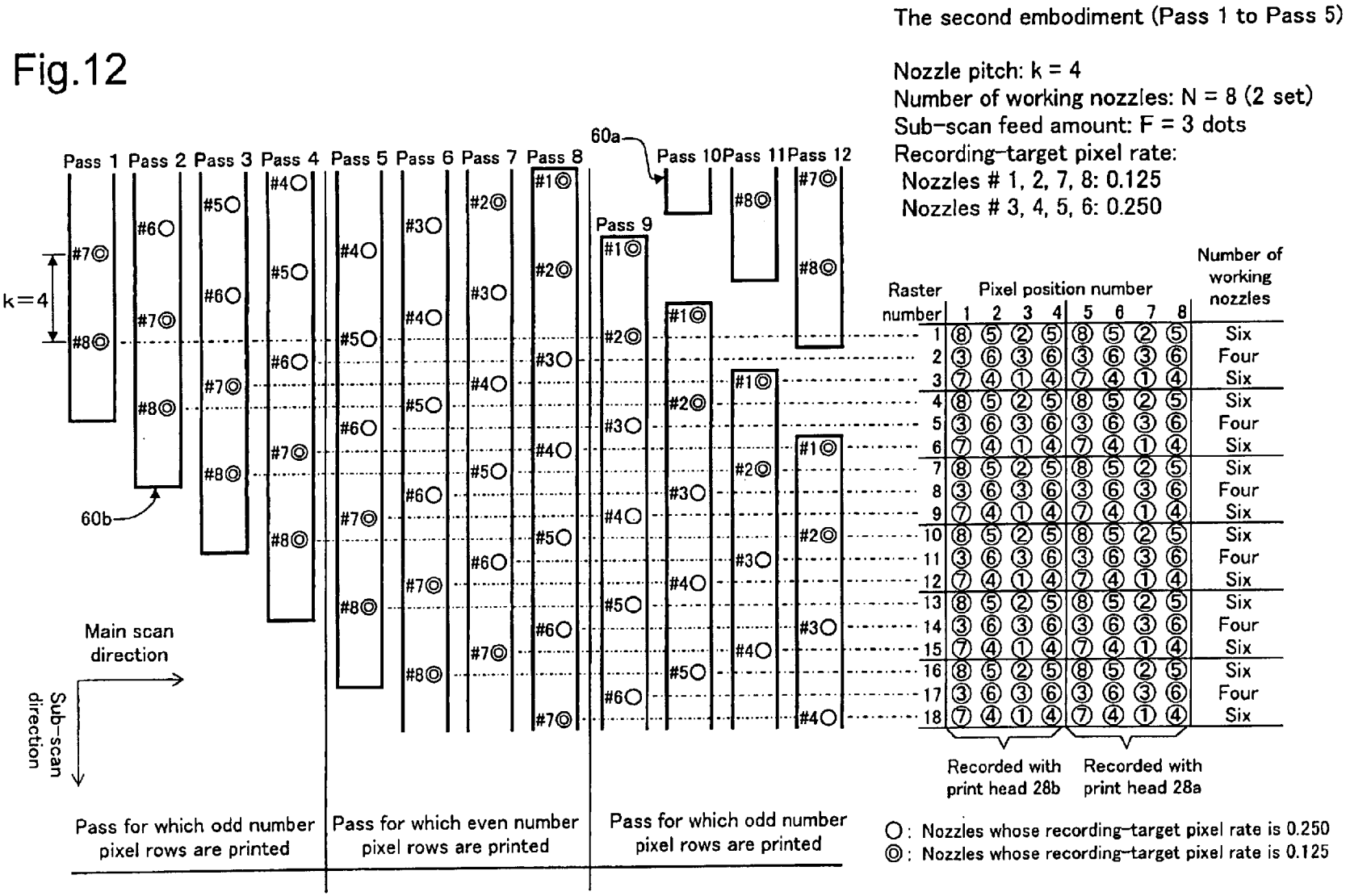
FIG. 12 is an explanatory view showing a dot recording method in a second embodiment of the invention.
Figure 13:
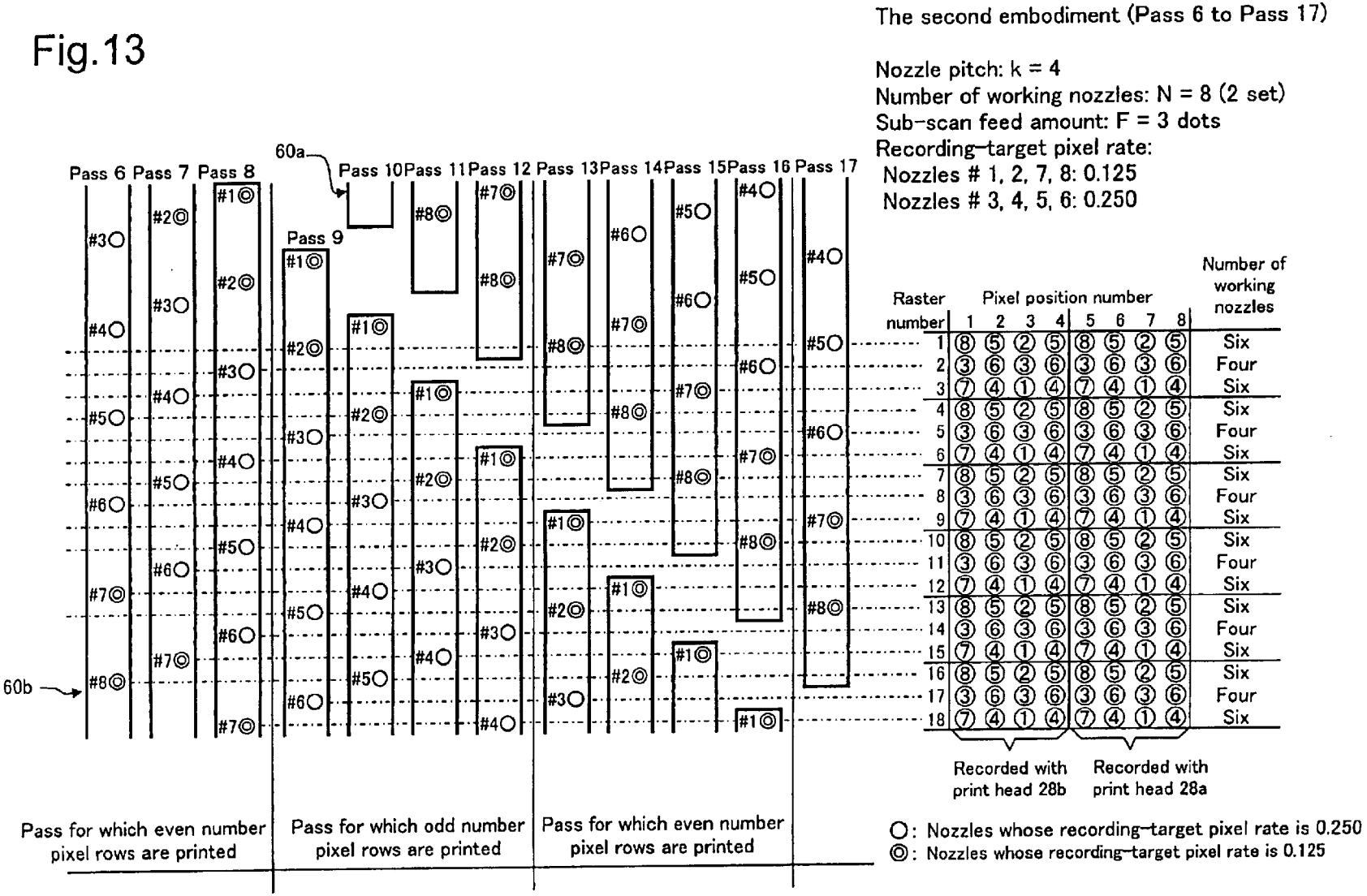
FIG. 13 is an explanatory view showing the dot recording method in the second embodiment of the invention.
Figure 14:
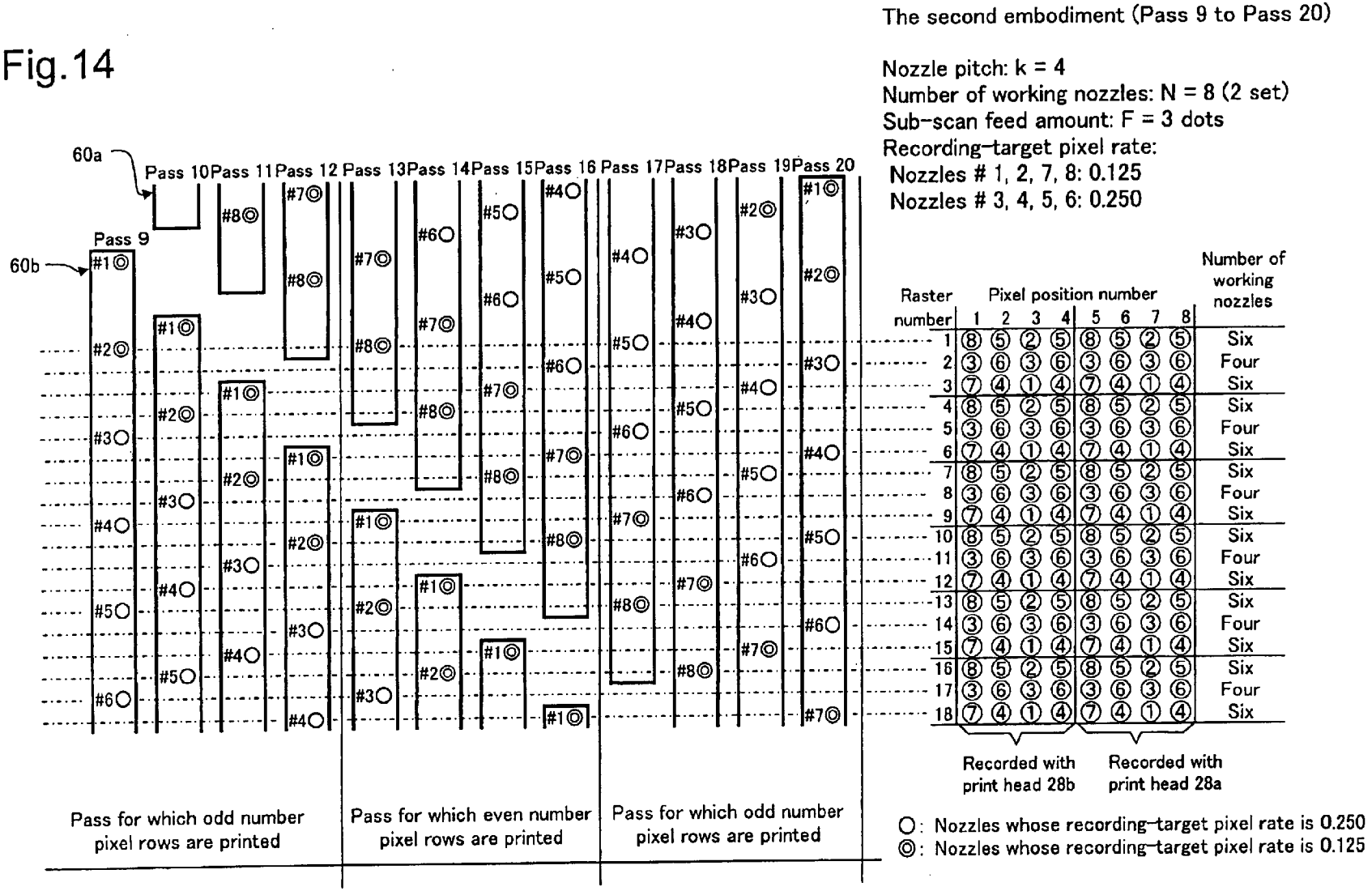
FIG. 14 is an explanatory view showing the dot recording method in the second embodiment of the invention.
Figure 15:
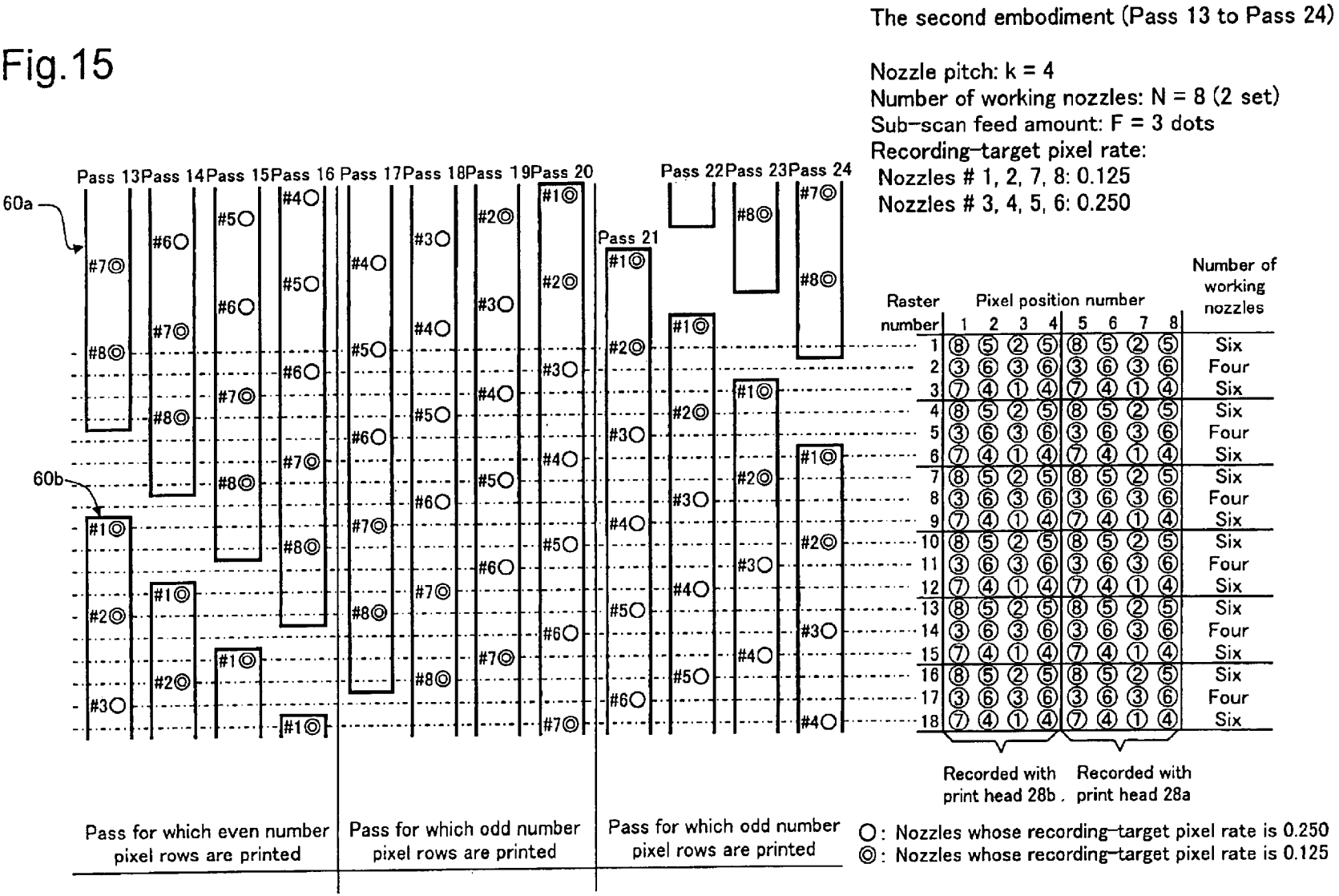
FIG. 15 is an explanatory view showing the dot recording method in the second embodiment of the invention.

FIG. 10 is an explanatory view showing a dot recording method in the first embodiment of the invention. The settings of the parameters in this recording method are N=8, k=4, F=7, and s=1. These parameters satisfy the conditions c1' to c3' described above with regard to the respective print heads 60*a* and 60*b*. Each of the print heads 60*a* and 60*b* can thus perform printing without any dropout or non-required overlap of recorded dots.

The pixel position numbers shown on the right side of FIG. 10 represent the order of pixels arrayed on each raster line. Each encircled figure represents the nozzle number allocated to the nozzle that takes charge of dot formation at the pixel position. In a first raster line, for example, dots are formed with a #3 nozzle of the print head 60*a* in pixels of odd-numbered pixel positions, while dots are formed alternately with two nozzles #1 and #8 of the print head 60*b* in pixels of even-numbered pixel positions.

In second through sixth raster lines, two nozzles included in the respective print heads 60*a* and 60*b* are actuated to form dots. For example, dots on the second raster line are formed with a #3 nozzle of the print head 60*b* and a #5 nozzle of the print head 60*a*. Dots on the third raster line are formed with a #5 nozzle of the print head 60*b* and a #7 nozzle of the print head 60*a*. In the specification hereof, each pixel position having an odd pixel position number is called an odd-numbered pixel position, whereas each pixel position having an even pixel position number is called an even-numbered pixel position. In the description below, the suffix to the nozzle number expresses the print head to which the nozzle belongs to. For example, the #3 nozzle of the print head 60*b* is expressed as the #3*b* nozzle, and the #1 nozzles of the print heads 60*a* and 60*b* are expressed as the #1*ab* nozzles.

In general, (1+7×n)-th raster lines are formed with #1*b*, #8*b*, and #3*a* nozzles, (2+7×n)-th raster lines are formed with #3*b* and #5*a* nozzles, (3+7×n)-th raster lines are formed with #5*b* and #7*a* nozzles, (4+7×n)-th raster lines are formed with #7*b* and #2*a* nozzles, (5+7×n)-th raster lines are formed with #2*b* and #4*a* nozzles, (6+7×n)-th raster lines are formed with #4*b* and #6*a* nozzles, and (7+7×n)-th raster lines are formed with #6*b*, #1*a*, and #8*a* nozzles. Here the small letter 'n' represents a non-negative integer.

This recording method is set to record dots on each raster line with multiple print heads. Such setting desirably prevents the printing quality from being significantly deteriorated, due to an attachment error of part of the print heads, in the course of printing with multiple print heads.

The recording-target pixel rates of the respective nozzles are given below in the arrangement of the first embodiment. The 'recording-target pixel rate' of a certain nozzle means the rate of pixels, in which dots are to be formed by the certain nozzle in the pass of one raster line, among multiple nozzles taking charge of recording in each raster line. In each of the (1+7×n)-th raster lines, for example, the odd-numbered pixel positions are formed only with the #3*a* nozzle, while the even-numbered pixel positions are formed evenly with the #1*b* and #8*b* nozzles. The recording-target pixel rate of the #3*a* nozzle is accordingly 0.50, and the recording-target pixel rates of the #1*b* and #8*b* nozzles are 0.25. According to the definition, the sum of the recording-target pixel rates of multiple nozzles that take charge of dot formation on each raster line is equal to 1.0.

Each of the (2+7×n)-th raster lines is recorded evenly with the #3*b* and #5*a* nozzles. Similarly, each of the (3+7×n)-th raster lines is recorded evenly with the #5*b* and #7*a* nozzles, each of the (4+7×n)-th raster lines is recorded evenly with the #7*b* and #2*a* nozzles, each of the (5+7×n)-th raster lines is recorded evenly with the #2*b* and #4*a* nozzles, and each of the (6+7×n)-th raster lines is recorded evenly with the #4*b* and #6*a* nozzles. The recording-target pixel rates of these nozzles are accordingly 0.5.

In each of the (7+7×n)-th raster lines, however, the odd-numbered pixel positions are formed with the #6*b* nozzle, while the even-numbered pixel positions are formed evenly with the #1*a* and #8*a* nozzles. The recording target pixel rate of the #6*b* nozzle is accordingly 0.5, and the recording-target pixel rates of the #1*a* and #8*a* nozzles are 0.25.

These results are summarized with regard to the nozzle numbers:

(1) The recording-target pixel rates of the #1*ab* and #8*ab* nozzles are all 0.25. These nozzles are located at the ends on the print heads 60*a* and 60*b*.

(2) The recording-target pixel rates of the #2*ab*, #3*ab*, #4*ab*, #5*ab*, #6*ab*, and #7*ab* nozzles are all 0.50. These nozzles are located closer to the center in the sub-scan direction on the print heads 60*a* and 60*b*. In this manner, the nozzle closer to the center in the sub-scan direction is set to have the greater recording-target pixel rate, among multiple nozzles on each print head.

FIG. 11 is an explanatory view showing raster data allocated to the respective nozzles in the first embodiment of the invention. The raster data representing the dot formation status on the first raster line have the values of 1, 1, 1, 1, 0, 1, . . . Here the value '1' represents dot formation at the pixel position, while the value '0' represents no dot formation.

In the first raster line, the #3*a* nozzle takes charge of recording at (1+4×n)-th and (3+4×n)-th pixel positions. The #1*b* nozzle takes charge of recording at (2+4×n)-th pixel positions, and the #8*b* nozzle takes charge of recording at (4+4×n)-th pixel positions. The raster data representing the dot formation status on the first raster line are thus allocated in the following manner. The signal transmitted to the print head 60*a* and the signal transmitted to the print head 60*b* have a time difference by a timing corresponding to the offset shown in FIG. 9.

The raster data on the (1+4×n)-th and (3+4×n)-th pixel positions are allocated to the #3*a* nozzle that takes charge of recording at these pixel positions. The raster data on the other pixel positions allocated to the #3*a* nozzle are dummy data. Here the 'dummy data' represents data of a value '0' allocated regardless of the values of the original raster data. Similarly, the raster data on the (2+4×n)-th pixel positions are allocated to the #1*b* nozzle that takes charge of recording at these pixel positions. The raster data on the (4+4×n)-th pixel positions are allocated to the #8*b* nozzle that takes charge of recording at these pixel positions. The raster data with regard to the other raster lines are allocated to the corresponding nozzles in a similar manner.

In the structure of the first embodiment, the nozzle located closer to the center in the sub-scan direction is set to have the greater recording-target pixel rate, among multiple nozzles on each print head. This arrangement effectively reduces deterioration of the printing quality due to the deviation of the ink dot forming position, in the course of printing with multiple print heads. Multiple nozzles included in multiple print heads take charge of recording in each main scan line. This arrangement thus prevents the printing quality from being significantly deteriorated due to an attachment error of part of the print heads.

Here the expression 'to have the greater recording-target pixel rate' is used in a wide sense and means that 'the recording-target pixel rate of a nozzle relatively close to the center in the sub-scan direction is not less than the recording-target pixel rate of another nozzle'. For example, the recording-target pixel rate (0.50) of the #3 nozzle is not less than the recording-target pixel rate (0.50) of the #2 nozzle. This accordingly satisfies the condition that 'the recording-target pixel rate of a nozzle relatively close to the center in the sub-scan direction is not less than the recording-target pixel rate of another nozzle'.

D. Recording Method in Second Embodiment

FIGS. 12 through 15 are explanatory views showing a dot recording method in a second embodiment of the invention. The settings of the parameters in this recording method are N=8, k=4, F=3, and s=2. These parameters satisfy the conditions c1' to c3' described above with regard to the respective print heads 60*a* and 60*b*. Each of the print heads 60*a* and 60*b* can thus perform printing without any dropout or non-required overlap of recorded dots.

The differences between this recording method and the recording method of the first embodiment are that the sub-scan feed amount F decreases from 7 dots to 3 dots, that the number of scan repetitions s increases from 1 to 2, and that dots are formed only at odd-numbered pixel positions or at even-numbered pixel positions in each pass.

In this recording method, dots are formed only at the odd-numbered pixel positions or at the even-numbered pixel positions in each pass, so that an intermittent degree q is equal to 2. Here the intermittent degree q is obtained by dividing the total number of pixels included in one raster line by the number of pixels, in which dots are formable by one nozzle in one pass. This arrangement of intermittent dot formation heightens the main scan speed as discussed below.

Figure 16A:
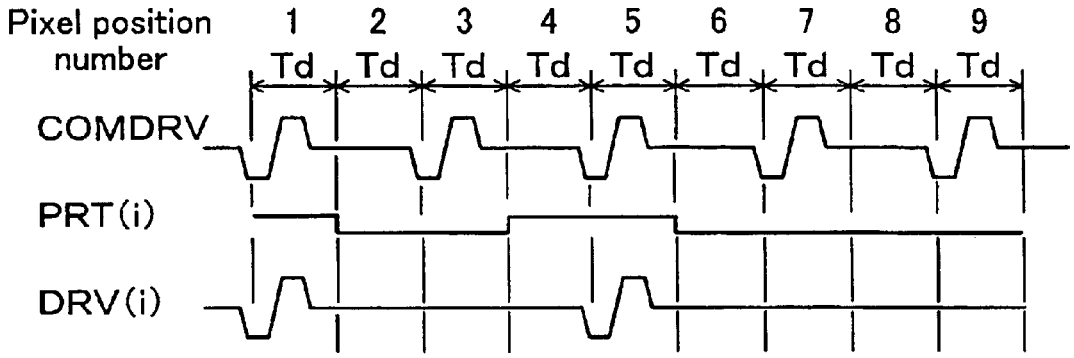
FIGS. 16A and 16B are timing charts showing operations of the head drive circuit in an intermittent overlapping interlace method.
Figure 16B:
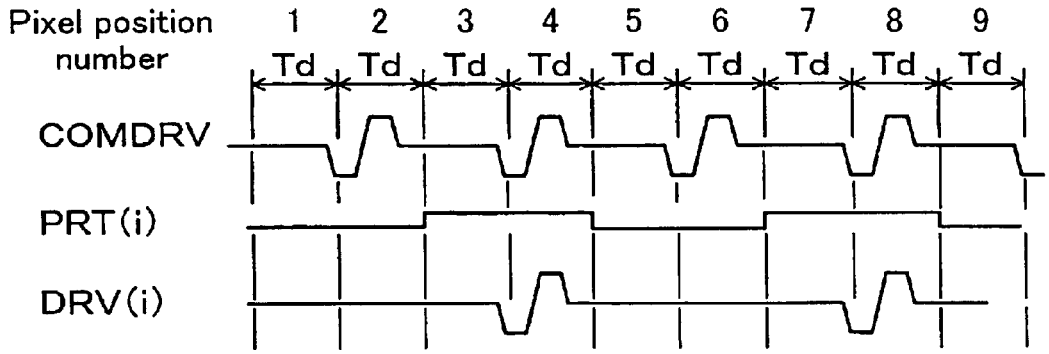

FIGS. 16A and 16B are timing charts showing operations of the head drive circuit 52 in an intermittent overlapping interlace method. FIG. 16A is a timing chart in the case of forming dots at the odd-numbered pixel positions, and FIG. 16B is a timing chart in the case of forming dots at the even-numbered pixel positions. In this embodiment, an original drive signal COMDRV actuated to form dots at the odd-numbered pixel positions and an original drive signal COMDRV actuated to form dots at the even-numbered pixel positions are used to record each raster line.

In the illustrated example, the waveform of the original drive signal COMDRV is generated at a rate of 1 output pixel to 2 output pixels. In response to the waveform of the original drive signal shown in FIG. 16A, dots are formed only at the odd-numbered pixel positions, even if the serial print signal PRT(i) is fixed to the level '1'. In a similar manner, in response to the waveform of the original drive signal shown in FIG. 16B, dots are formed only at the even-numbered pixel positions, even if the serial print signal PRT(i) is fixed to the level '1'. The arrangement of making the waveform of the original drive signal COMDRV generated only at the intermittent output pixel positions heightens the main scan speed.

The main scan speed is generally restricted by the upper limit of the nozzle driving frequency (the number of ink ejections per unit time). In the structure of the second embodiment, however, ink is ejected intermittently at a rate of 1 pixel position to 2 pixel positions (that is, at a rate of ½) in the main scan direction. This arrangement doubles the main scan speed. Each raster line is recorded as discussed below in response to this original drive signal.

As clearly seen from FIGS. 12 through 15, in this recording method, the print head 60*b* takes charge of recording at pixels of (1+8×n)-th to (4+8×n)-th pixel position numbers, whereas the print head 60*a* takes charge of recording at pixels of (5+8×n)-th to (8+8×n)-th pixel position numbers. This setting is only for the purpose of the better understanding of the explanation.

The first raster line is recorded in the following manner. With regard to the print head 60*b*, the pixels of (1+8×n)-th pixel position numbers are recorded with the #8*b* nozzle, the (2+8×n)-th and (4+8×n)-th pixels are recorded with the #5*b* nozzle, and the (3+8×n)-th pixels are recorded with the #2*b* nozzle. The recording-target pixel rates of the #2*b* and #8*b* nozzles, which implement recording at a rate of 1 pixel to 8 pixels, are thus 0.125. The recording-target pixel rate of the #5*b* nozzle, which implements recording at a rate of 2 pixels to 8 pixels, is 0.250.

With regard to the print head 60*a*, on the other hand, the (5+8×n)-th pixels are recorded with the #8*a* nozzle, the (6+8×n)-th and (8+8×n)-th pixels are recorded with the #5*a* nozzle, and the (7+8×n)-th pixels are recorded with the #2*a* nozzle. The recording-target pixel rates of the #2*a* and #8*a* nozzles are thus 0.125, and the recording-target pixel rate of the #5*a* nozzle is 0.250.

The second raster line is recorded in the following manner. With regard to the print head 60*b*, the pixels of (1+8×n)-th and (3+8×n)-th pixel position numbers are recorded with the #3*b* nozzle, whereas the (2+8×n)-th and (4+8×n)-th pixels are recorded with the #6*b* nozzle. With regard to the print head 60*a*, on the other hand, the pixels of (1+8×n)-th and (3+8×n)-th pixels are recorded with the #3*a* nozzle, whereas the (2+8×n)-th and (4+8×n)-th pixels are recorded with the #6*a* nozzle. The recording-target pixel rates of the #3*ab* and #6*ab* nozzles are thus all 0.250.

The third raster line is recorded in the following manner. With regard to the print head 60*b*, the pixels of (1+8×n)-th pixel position numbers are recorded with the #7*b* nozzle, the (2+8×n)-th and (4+8×n)-th pixels are recorded with the #4*b* nozzle, and the (3+8×n)-th pixels are recorded with the #1*b* nozzle. With regard to the print head 60*a*, on the other hand, the (5+8×n)-th pixels are recorded with the #7*a* nozzle, the (6+8×n)-th and (8+8×n)-th pixels are recorded with the #4*a* nozzle, and the (7+8×n)-th pixels are recorded with the #1*a* nozzle. The recording-target pixel rates of the #1*ab* and #7*ab* nozzles are thus 0.125, and the recording-target pixel rates of the #4*ab* nozzles are 0.250.

In general, (1+3×n)-th raster lines are recorded in the same manner as the first raster line, (2+3×n)-th raster lines are recorded in the same manner as the second raster line, and (3+3×n)-th raster lines are recorded in the same manner as the third raster line. The raster data allocated to the respective nozzles are shown in FIG. 17.

These results are summarized with regard to the nozzle numbers:

(1) The recording-target pixel rates of the #1*ab*, #2*ab*, #7*ab*, and #7*ab* nozzles are all 0.125.

(2) The recording-target pixel rates of the #3*ab*, #4*ab*, #5*ab*, and #6*ab* nozzles are all 0.250. In the intermittent overlapping recording method, the nozzle located closer to the center in the sub-scan direction is also set to have the greater recording-target pixel rate, among multiple nozzles on each print head.

As described above, the technique of the invention is applicable to the intermittent overlapping recording method. In the structure of forming dots only in an intermittent manner, the degree of freedom tends to be restricted in settings of the target pixels recorded with the respective nozzles. The effects of the invention are significant in this structure, since the respective nozzles often have non-uniform settings of the recording-target pixel rate.

E. Relation Between Number of Surplus Nozzles and Number of Overlaps

In the recording methods of the respective embodiments discussed above, the number of working nozzles N used for each main scan with regard to one color of each print head, the sub-scan feed amount F, the number of scan repetitions S, a number of surplus nozzles R, and g (g is an integer of not less than 1) are set to satisfy Equations (1) and (2) given below:

$$F=g\times k\pm 1 \quad (1)$$

$$N=F\times S+R \quad (2)$$

Here N is an integer of not less than 3, and F, g, S, and R are all integers of not less than 1. The number of surplus nozzles R represents the number of nozzles that is surplus to the required number of nozzles to attain recording at a preset number of scan repetitions S.

This setting increases the number of overlaps in the raster lines recorded with nozzles in the vicinity of the ends in the sub-scan direction on the respective print heads 60*a* and 60*b*. The dots formed with the nozzles in the vicinity of the ends have relatively large positional deviations. The increased number of overlaps in such raster lines effectively reduces deterioration of the printing quality due to the deviations of the dot forming position.

Figure 18:
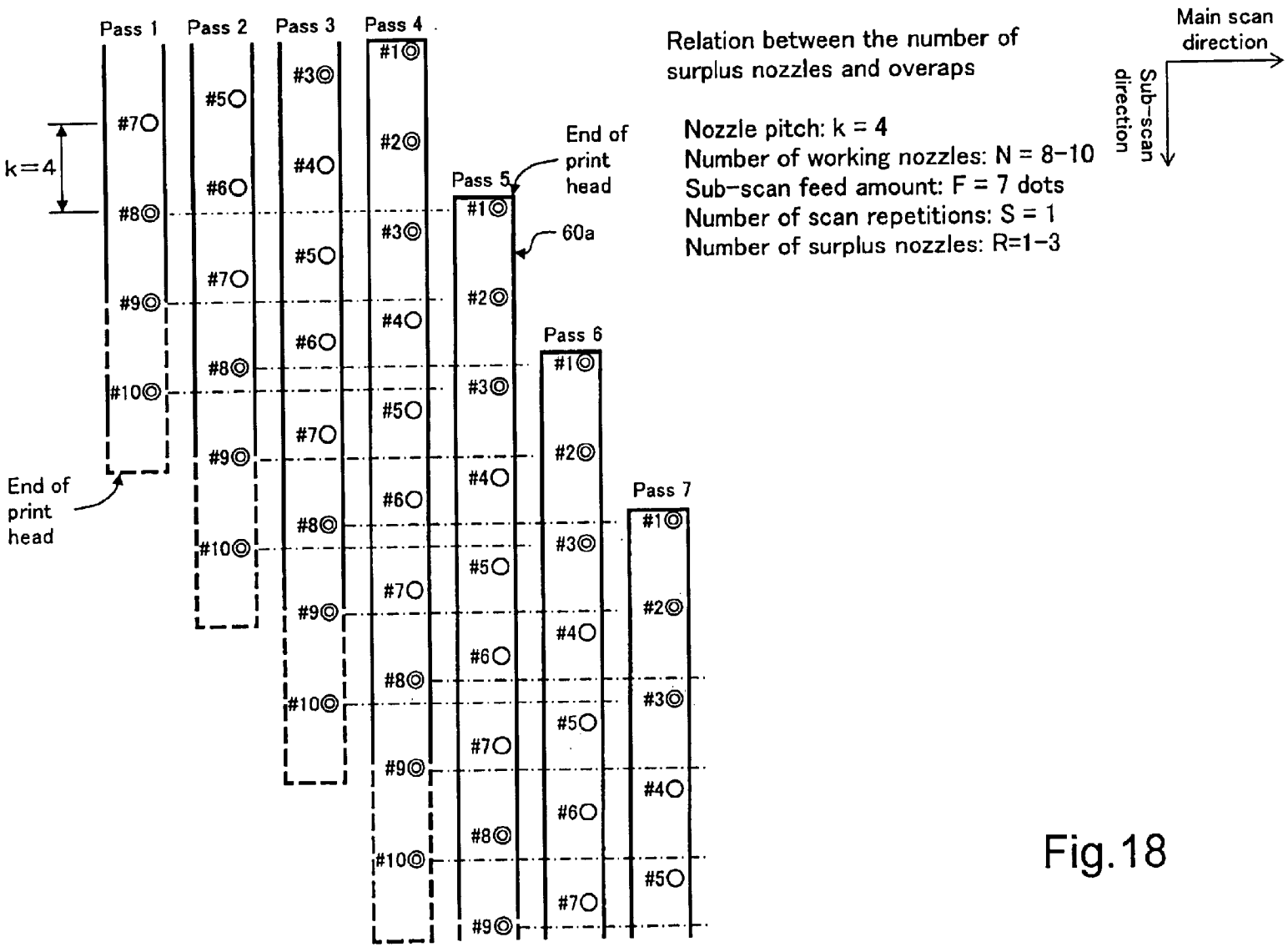
FIG. 18 is an explanatory view showing a relation between the number of surplus nozzles and the number of overlaps.

FIG. 18 is an explanatory view showing a relation between the number of surplus nozzles the number of overlaps at the number of scan repetitions S=1. In the illustrated example, the number of nozzles is increased from 8 of the first embodiment to 10. For example, when the number of nozzles is equal to 8 of the first embodiment, the number of surplus nozzles R is equal to 1 (=8−7×1(N−F×S)). As shown in FIG. 18, the position of the #8 nozzle in the sub-scan direction coincides with the position of the #1 nozzle in the sub-scan direction, so that the #8 and #1 nozzles form identical raster lines. The number of overlaps thus increases only in the raster lines recorded with the first nozzle from the end of the print heads 60*a*.

With an increase in number of nozzles by one to make the number of surplus nozzles R equal to 2, the number of overlaps increases in the raster lines recorded with the first and the second nozzles from the end of the print head 60*a*. With a further increase in number of nozzles by another one to make the number of surplus nozzles R equal to 3, the number of overlaps increases in the raster lines recorded with the first through the third nozzles from the end of the print head 60*a*.

In this manner, an increase in number of surplus nozzles R results in an increase in number of overlaps in raster lines recorded with nozzles up to R-th nozzle from the end. The increased number of overlaps, however, lowers the print speed as a trade-off.

The nozzle closer to the end of the print head generally has a greater deviation of the dot forming position. It is accordingly preferable to set the adequate number of surplus nozzles R by a trade-off between the print speed and the deviation of the dot forming position with the nozzle located at the end of the print head. The number of surplus nozzles R is preferably not less than 1 and more preferably in a range of 2 to 5. The number of surplus nozzles R may be specified alternatively as a preset fraction (for example, 10%) of the number of working nozzles N.

F. Modifications

The above embodiments and applications are to be considered in all aspects as illustrative and not restrictive. There may be many modifications, changes, and alterations without departing from the scope or spirit of the main characteristics of the present invention. Some examples of possible modification are given below.

F-1. In the embodiments discussed above, the nozzle closer to the center in the sub-scan direction is set to have the greater recording-target pixel rate, among multiple nozzles on each print head in the whole printing area. One possible modification may allow the nozzle closer to the center in the sub-scan direction on each print head to have a smaller recording-target pixel rate in some raster lines.

Figure 19:
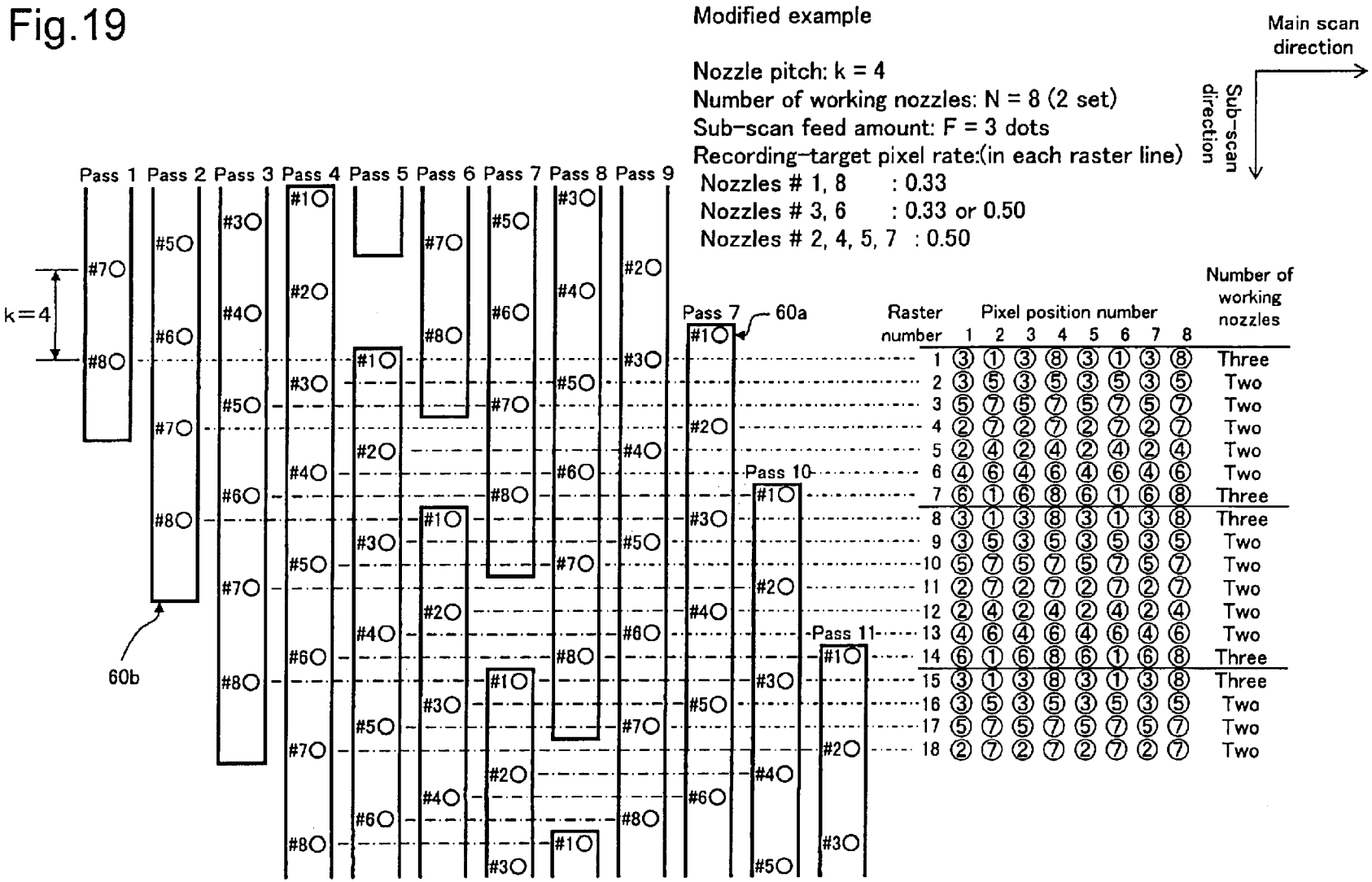
FIG. 19 is an explanatory view showing a dot recording method in one modified example of the invention.

For example, in a modified example of FIG. 19, the recording-target pixel rates of #2 and #7 nozzles are 0.5, whereas the recording-target pixel rates of #3 and #6 nozzles are 0.33. The setting of this modified example allows the nozzle closer to the center in the sub-scan direction on each print head to have a smaller recording-target pixel rate.

The raster lines recorded with the #2 and #7 nozzles are different from the raster lines recorded with the #3 and #6 nozzles. The #2 and #7 nozzles form (3+7×n)-th to (5+7×n)-th raster lines, while the #3 and #6 nozzles form (1+7×n)-th, (2+7×n)-th, (6+7×n)-th, and (7+7×n)-th raster lines. The technique of the invention generally sets the nozzle located closer to the center in the sub-scan direction to have the greater recording-target pixel rate in each raster line, among multiple nozzles on each print head.

F-2. The technique of the invention is not restricted to color printing but is also applicable to monochrome printing. The invention may also be applied to a printing method that forms multiple dots in each pixel to express multiple tones, as well as to drum printers. In the drum printers, a drum rotating direction and a carriage moving direction respectively correspond to the main scan direction and the sub-scan direction. The technique of the invention is not limited to ink jet printers but is applicable in general to dot recording apparatuses that record dots on the surface of a printing medium with a record head having multiple nozzle arrays.

F-3. In the embodiments discussed above, part of the construction actualized by the hardware may be replaced by software. On the contrary, part of the configuration actualized by the software may be replaced by the hardware. For example, part or all of the functions of the printer driver 96 shown in FIG. 1 may be executed by the control circuit 40 in the printer 20. In this case, part or all of the functions of the computer 90 as the print control apparatus of generating print data are executed by the control circuit 40 of the printer.

When part or all of the functions of the invention are actualized by the software configuration, the software may be provided in the form of storage in a computer readable recording medium. In the description of the present invention, the 'computer readable recording medium' is not restricted to portable recording media, such as flexible disks and CD-ROMs, but includes internal storage devices of the computer like various RAMs and ROMs as well as external storage devices fixed to the computer like hard disks.

What is claimed is:

1. A printing apparatus for printing by recording ink dots on a print medium while moving a print head group in a main scan direction, wherein the print head group includes a plurality of print heads located at different positions in a sub-scan direction, each of the plurality of print heads having a plurality of nozzles arrayed along the sub-scan direction; and wherein the printing apparatus is configured such that a nozzle located closer to a center in the sub-scan direction on the each print head has a greater recording-target pixel rate, the recording-target pixel rate being a rate of pixels in which the nozzle is in charge of a formation of a dot while the nozzle among the plurality of nozzles passing over one raster line.

2. The printing apparatus in accordance with claim 1, wherein the printing apparatus is configured such that a plurality of print heads are used to record each raster line.

3. The printing apparatus in accordance with claim 1, wherein the recording-target pixel rate of each nozzle is set such that each of the plurality of nozzles is allowed to form dots intermittently at a rate of one in q on a plurality of pixel positions on the raster line, q being an integer of at least two, thereby completing dot formation on the raster line while the plurality of nozzles scan on the raster line in a printing execution area of the print medium during a plurality of main scans.

4. The printing apparatus in accordance with claim 1, wherein the plurality of print heads include a plurality of nozzles arrayed in the sub-scan direction at a pitch of k×P, k being an integer of at least two;

the printing apparatus further comprises:

a main scan driver configured to move the print heads in the main scan direction;

a sub-scan driver configured to move the print medium in the sub-scan direction between the main scans;

a print head driver configured to drive the print head group to eject ink drops during the main scan of the print heads; and a controller configured to control the main scan driver, the sub-scan driver, and the print head driver, wherein the controller in a specific print mode is capable of:

(a) controlling the print head driver such that the print head group ejects ink drops so as to record each raster lines with nozzles included in the plurality of print heads; and (b) controlling the sub-scan driver such that the sub-scan driver performs a constant sub-scan of F×P being a minimum pitch of dots in the sub-scan direction, F being an integer, wherein the specific print mode is configured such that N and parameters F, g, S, R satisfy equations (1) and (2):

$$F=g\times k\pm 1 \quad (1)$$

$$N=F\times S+R \quad (2)$$

where N denotes a number of working nozzles for ejecting one color of ink in each print head during each main scan, and N is an integer of at least three, and the parameters g, S, R are an integer of at least one.

5. The printing apparatus in accordance with claim 4, wherein the R is any of integers between two and five, inclusive.

6. A printing method of printing by recording ink dots on a print medium, comprising the steps of:

(a) moving a print head group in a main scan direction, the print head group including a plurality of print heads located at different positions in a sub-scan direction, each of the plurality of print heads having a plurality of nozzles arrayed along the sub-scan direction;

(b) setting a recording-target pixel rate such that a nozzle located closer to a center in the sub-scan direction on the each print head has a greater recording-target pixel rate, the recording-target pixel rate being a rate of pixels in which the nozzle is in charge of a formation of a dot while the nozzle among the plurality of nozzles passing over one raster line.

7. The printing method in accordance with claim 6, further comprising the step of:

(c) using a plurality of print heads to record each raster line.

8. The printing method in accordance with claim 6, further comprising the step of:

(d) setting the recording-target pixel rate of each nozzle such that each of the plurality of nozzles is allowed to form dots intermittently at a rate of one in q on a plurality of pixel positions on the raster line, q being an integer of at least two, thereby completing dot formation on the raster line while the plurality of nozzles scan on the raster line in a printing execution area of the print medium during a plurality of main scans.

9. The printing method in accordance with claim 6, wherein the plurality of print heads include a plurality of nozzles arrayed in the sub-scan direction at a pitch of k×P, k being an integer of at least two;

the printing method further comprises the step of:

(e) moving the print heads in the main scan direction;

(f) moving the print medium in the sub-scan direction between the main scans;

(g) driving the print head group to eject ink drops during the main scan of the print heads; and (h) controlling the main scan driver, the sub-scan driver, and the print head driver, wherein the step (g) includes the following steps in a specific print mode:

(h-1) controlling the print head driver such that the print head group ejects ink drops so as to record each raster lines with nozzles included in the plurality of print heads; and (h-2) controlling the sub-scan driver such that the sub-scan driver performs a constant sub-scan of F×P, being a minimum pitch of dots in the sub-scan direction, F being an integer, wherein the specific print mode is configured such that N and parameters F, g, S, R satisfy equations (1) and (2):

$$F=g\times k\pm 1 \quad (1)$$

$$N=F\times S+R \quad (2)$$

where N denotes a number of working nozzles for ejecting one color of ink in each print head during each main scan, and N is an integer of at least three, and the parameters g, S, R are an integer of at least one.

10. The printing method in accordance with claim 9, wherein the R is any of integers between two and five, inclusive.

11. A computer-readable medium storing a computer program for causing a printing apparatus to print by recording ink dots on a print medium, the computer program comprising programs causing the printing apparatus to perform:

a function to move a print head group in a main scan direction, the print head group including a plurality of print heads located at different positions in a sub-scan direction, each of the plurality of print head having a plurality of nozzles arrayed along the sub-scan direction;

a function to set a recording-target pixel rate such that a nozzle located closer to a center in the sub-scan direction on the each print head has a greater recording-target pixel rate, the recording-target pixel rate being a rate of pixels in which the nozzle is in charge of a formation of a dot while the nozzle among the plurality of nozzles passing over one raster line.

12. The computer-readable medium in accordance with claim 11, the computer program further comprising a program for controlling the printing apparatus to use a plurality of print heads to record each raster line.

13. The computer-readable medium in accordance with claim 11, the computer program further comprising a program for controlling the printing apparatus to set the recording-target pixel rate of each nozzle such that each of the plurality of nozzles is allowed to form dots intermittently at a rate of one in q on a plurality of pixel positions on the raster line, q being an integer of at least two, thereby completing dot formation on the raster line while the plurality of nozzles scanning on the raster line in a printing execution area of the print medium during a plurality of main scans.

14. The computer-readable medium in accordance with claim 11, wherein the plurality of print heads include a plurality of nozzles arrayed in the sub-scan direction at a pitch of k×P, k being an integer of at least two;

the computer program further comprising a program causing the printing apparatus to perform;

a function to move the print heads in the main scan direction;

a function to move the print medium in the sub-scan direction between the main scans;

a function to drive the print head group to eject ink drops during the main scan of the print heads; and a function to control the main scan driver, the sub-scan driver, and the print head driver, wherein the function to control includes following functions in a specific print mode:

a function to control the print head driver such that the print head group ejects ink drops so as to record each raster lines with nozzles included in the plurality of print heads; and a function to control the sub-scan driver such that the sub-scan driver performs a constant sub-scan of F×P, P being a minimum pitch of dots in the sub-scan direction, F being an integer, wherein the specific print mode is configured such that N and parameters F, g, S, R satisfy equations (1) and (2):

$$F=g\times k+1 \quad (1)$$

$$N=F\times S+R \quad (2)$$

where N denotes a number of working nozzles for ejecting one color of ink in each print head during each main scan, and N is an integer of at least three, and the parameters g, S, R are an integer of at least one.

15. The computer-readable medium in accordance with claim 14, wherein the R is any of integers between two and five, inclusive.

* * * * *